US007010936B2

(12) United States Patent
Rini et al.

(10) Patent No.: US 7,010,936 B2
(45) Date of Patent: Mar. 14, 2006

(54) METHOD AND APPARATUS FOR HIGHLY EFFICIENT COMPACT VAPOR COMPRESSION COOLING

(75) Inventors: Daniel P. Rini, Orlando, FL (US); Louis Chow, Winter Park, FL (US); H. Randolph Anderson, Clermont, FL (US); Jayanta Sankar Kapat, Oviedo, FL (US); Bradley Carman, Orlando, FL (US); Brian Gulliver, Orange City, FL (US); Jose Mauricio Recio, Parkland, FL (US)

(73) Assignee: Rini Technologies, Inc., Oviedo, FL (US)

( * ) Notice: Subject to any disclaimer, the term of this patent is extended or adjusted under 35 U.S.C. 154(b) by 0 days.

(21) Appl. No.: 10/625,014

(22) Filed: Jul. 22, 2003

(65) Prior Publication Data

US 2004/0129018 A1 Jul. 8, 2004

Related U.S. Application Data

(60) Provisional application No. 60/413,056, filed on Sep. 24, 2002.

(51) Int. Cl.
*F25B 39/04* (2006.01)

(52) U.S. Cl. ..... 62/507; 165/154

(58) Field of Classification Search ..... 62/506, 62/507; 165/154–156
See application file for complete search history.

(56) References Cited

U.S. PATENT DOCUMENTS 1,569,499 A * 1/1926 Emil ..... 165/156
1,896,081 A 2/1933 Hampson
1,896,953 A 2/1933 Hassell
1,974,317 A 9/1934 Steenstrup
2,566,865 A 9/1951 Wingerter (Continued)

FOREIGN PATENT DOCUMENTS

CH 106 312 A 1/1925

(Continued)

OTHER PUBLICATIONS

Li, Q. et al. "Heat Transfer and Pressure Drop Characteristics in Rectangular Channels with Elliptic Pin Fins" *International Journal of Heat and Fluid Flow*, 1998, pp. 245-250; vol. 19.

(Continued)

*Primary Examiner*—William E. Tapolcai
(74) *Attorney, Agent, or Firm*—Saliwanchik, Lloyd & Saliwanchik

(57) ABSTRACT

The subject invention pertains to a method and apparatus for cooling. In a specific embodiment, the subject invention relates to a lightweight, compact, reliable, and efficient cooling system. The subject system can provide heat stress relief to individuals operating under, for example, hazardous conditions, or in elevated temperatures, while wearing protective clothing. The subject invention also relates to a condenser for transferring heat from a refrigerant to an external fluid in thermal contact with the condenser. The subject condenser can have a heat transfer surface and can be designed for an external fluid, such as air, to flow across the heat transfer surface and allow the transfer of heat from heat transfer surface to the external fluid. In a specific embodiment, the flow of the external fluid is parallel to the heat transfer surface. In another specific embodiment, the heat transfer surface can incorporate surface enhancements which enhance the transfer of heat from the heat transfer surface to the external fluid. In another specific embodiment, an outer layer can be positioned above the heat transfer surface to create a volume between the heat transfer surface and the outer layer through which the external fluid can flow.

63 Claims, 14 Drawing Sheets

U.S. PATENT DOCUMENTS

| | | | | | |
|---|---|---|---|---|---|
| 2,768,508 | A | | 10/1956 | Guyton | |
| 2,920,463 | A | | 1/1960 | Gould | |
| 3,152,455 | A | * | 10/1964 | Ware | 62/184 |
| 3,200,480 | A | | 8/1965 | Heuer | |
| 3,214,087 | A | | 10/1965 | Luck | |
| 3,529,432 | A | * | 9/1970 | Nussbaum | 62/196.3 |
| 3,555,848 | A | | 1/1971 | Johnson | |
| 3,877,247 | A | * | 4/1975 | Le Couturier | 62/428 |
| 3,926,008 | A | * | 12/1975 | Webber | 62/200 |
| 4,287,724 | A | | 9/1981 | Clark | |
| 4,300,630 | A | | 11/1981 | Trojani | |
| 4,555,915 | A | * | 12/1985 | Dasher | 62/448 |
| 4,630,669 | A | | 12/1986 | Kessler et al. | |
| 5,097,897 | A | | 3/1992 | Watanabe et al. | |
| 5,502,983 | A | * | 4/1996 | Dasher | 62/454 |
| 5,511,384 | A | * | 4/1996 | Likitcheva | 62/59 |
| 5,570,583 | A | * | 11/1996 | Boehde et al. | 62/84 |
| 5,660,050 | A | * | 8/1997 | Wilson et al. | 62/125 |
| 5,950,445 | A | * | 9/1999 | Wang | 62/259.4 |
| 5,974,828 | A | * | 11/1999 | Guerand | 62/509 |
| 6,370,775 | B1 | * | 4/2002 | Reagen et al. | 29/890.07 |
| 6,499,534 | B1 | * | 12/2002 | Tawney et al. | 165/156 |

FOREIGN PATENT DOCUMENTS

| | | | |
|---|---|---|---|
| DE | 160 351 | C | 5/1905 |
| DE | 848 656 | C | 9/1952 |
| FR | 971 287 | A | 1/1951 |
| FR | 1 158 943 | A | 6/1958 |
| GB | 1 590 923 | A | 6/1981 |
| GB | 2 107 852 | A | 5/1983 |

OTHER PUBLICATIONS

Ogura, I. "The Ogura-Wankel compressor-Application of Wankal Rotary Concept as Automotive Air Conditioning Compressor" *International Congress & Exposition*, 1982.

XP001187086 "Advanced Lightweight Microclimate Cooling System (ALMCS)" *Natick Soldier Center*, Dec. 19, 2001.

XP001187087 "Portable Vapor-Compression Cooling System (PVCS)" *Natick Soldier Center*, Dec. 19, 2001.

* cited by examiner

METHOD AND APPARATUS FOR HIGHLY EFFICIENT COMPACT VAPOR COMPRESSION COOLING

CROSS-REFERENCE TO RELATED APPLICATION

This application claims the benefit of U.S. Provisional Application Ser. No. 60/413,056, filed Sep. 24, 2002.

BACKGROUND OF THE INVENTION

The subject invention relates to microclimate cooling, and a miniature cooling system that can be used for any purpose that requires a compact cooling system. Such applications include, but are not limited to, microelectronics cooling such as computer processors and laser diodes, personal cooling systems, and portable cooling systems.

Clothing that protects soldiers, first responders, and other emergency personnel from chemical, biological, nuclear, and/or other similar threats can subject the individuals to heat stress. Certain hazardous environments can require the use of PPE (personal protective ensembles) with level A protection, which can place the working individual in an encapsulating micro-environment. These PPE can significantly diminish the ability of the body to reject heat to the external environment, leading to symptoms ranging from muscular weakness, dizziness and physical discomfort to more severe, life-threatening conditions such as heat exhaustion or heat stroke. In any case, the operational performance of the personnel wearing PPE can become severely impaired. The use of an auxiliary, portable microclimate cooling system can mitigate these effects, eliminate heat stress casualties, and reduce water consumption. At the present time, the efforts to develop a microclimate system have been limited to existing design concepts and use of a large number of commercial off-the-shelf components. The subject microclimate system can incorporate miniaturization and MEMS technology, in order to provide performance that cannot be matched simply by using smaller versions of currently available designs.

An effective compact cooling system (Holtzapple and Allen, 1983) should preferably satisfy the dual requirements of a high coefficient of performance and a light and compact design. One example of an effective and useful microclimate system preferably would be able to remove at least 120 W of heat while consuming no more than 50 W of electrical power for at least about 4 hours of operation. This would suggest that for this particular example the microclimate system would have a coefficient of performance, or heat removal to power input ratio, of 2.4. In conventional designs, the requirements of a high coefficient of performance and a light and compact design typically work against each other.

Current cooling methods, such as thermoelectric cooling and traditional refrigeration cycles, have a high coefficient of performance and efficient design size within certain cooling ranges. While thermoelectric coolers have a coefficient of performance close to 1.0 and a very small volumetric design relative to the cooling capacity when operating in the 10 to 100 watt range, the coefficient of performance of commercially available thermo-electric devices tend be at or below 0.6 when applied to higher cooling capacities. In personal or portable cooling units heat removal rates of this range are inadequate. An alternative to mitigating the lack of performance and increase cooling capacity would be to use more units in series or parallel, thus increasing the overall size and weight of the cooling unit to beyond the limits of portable, microclimate dimensions.

Commercially available refrigeration cycles also have difficulties in satisfying the heat load requirements of microclimate and portable systems while maintaining a light and compact design. Commercially available unit designs are typically optimized for operation above a minimum cooling load of 500 watts, which is too much or unnecessary for microclimate systems. At or above this minimum cooling load refrigeration cycles exhibit a high coefficient of performance of almost never less than two and increases significantly with increasing heat load designs. Furthermore, the size and weight relative to the cooling capacity also decrease with increasing heat load designs. Application of these units to microclimate systems however is difficult due to the large size and weight of such units when scaling down to lower cooling ranges that are suitable for microclimate systems. It is extremely difficult to find a commercially available compressor alone which is smaller than 1 liter and weighs less than several pounds, and which is rated for a cooling load near or below 500 watts. The cycle would then need additional components such a condenser and evaporator to become effective.

Accordingly, there is need for a cooling system having a high coefficient of performance and a light compact design.

BRIEF DESCRIPTION OF THE INVENTION

The subject invention pertains to a method and apparatus for cooling. In a specific embodiment, the subject invention relates to a lightweight, compact, reliable, and efficient cooling system. The subject system can provide heat stress relief to individuals operating under, for example, hazardous conditions, or in elevated temperatures, while wearing protective clothing. The subject system can be utilized in other applications that can benefit from this type of cooling system. The performance of this system cannot be matched simply by using smaller versions of currently available designs. In a specific embodiment, the subject microclimate system can remove at least about 120 watts of heat while consuming less than about 50 watts of power, and weigh less than about 2.5 pounds while having less than about a 1000 cubic centimeter volume. In a further specific embodiment, the subject cooling system can remove at least about 300 Watts of heat while consuming less than about 100 Watts of electrical power, and can weigh less than about 3.5 pounds (not including the water jacket or the power source) within a volume of less than about 1500 cc or 1.5 L. In a specific embodiment, the subject system can run for at least about 4 hours or more with the use of batteries.

In a specific embodiment, the subject invention pertains to a cooling system having a total weight of less than about 3.5 pounds, a coefficient of performance of at least 2.4, and a volume of less than about 1500 cc with a cooling capacity between about 100 and about 500 watts. The subject cooling system can provide between 28 and 140 watts of cooling per pound and occupy between 3 and 15 cc of volume per watt of cooling. In comparison, commercially available units for cooling in this range would provide between 2.7 and 18.5 watts of cooling per pound and occupy a volume of between 48 and 240 cc per watt of cooling. Furthermore, commercially available units typically provide a coefficient of performance of 2 or less for this cooling range.

The subject system can be scaled to larger or smaller sizes for different applications. The subject system can incorporate a compressor and condenser design so as to achieve a high coefficient of performance and a light and compact design. A compressor can be a key component with respect to the overall performance of a vapor compression system, whereas a condenser can be a key component with respect to the overall weight and size. The subject cooling system can also utilize a miniaturized high efficiency motor design, along with integration of a compact heat exchanger for refrigerant evaporation and liquid pump.

A specific embodiment of the subject cooling system can involve the use of micro-fabrication techniques, an innovative rotary lobed compressor, a miniature high efficiency permanent magnet motor, a high efficiency condenser, a compact heat exchanger for refrigerant evaporation, and a liquid pump. In a specific embodiment, the subject system can provide approximately 200 watts of cooling for microclimate and other cooling environments.

The subject invention also relates to a condenser for transferring heat from a refrigerant to an external fluid in thermal contact with the condenser. The subject condenser can have a heat transfer surface and can be designed for an external fluid, such as air, to flow across the heat transfer surface and allow the transfer of heat from heat transfer surface to the external fluid. In a specific embodiment, the flow of the external fluid is parallel to the heat transfer surface. In another specific embodiment, the heat transfer surface can incorporate surface enhancements which enhance the transfer of heat from the heat transfer surface to the external fluid. In another specific embodiment, an outer layer can be positioned above the heat transfer surface to create a volume between the heat transfer surface and the outer layer through which the external fluid can flow. Such an outer layer can be thin to keep the weight of the system down. A portion, or all, of the outer layer can be thermally insulating, for example for use in cooling systems in contact with a person's skin or clothing. Alternatively, the outer layer can be thermally conducive to assist in thermal transfer to the environment. In an embodiment with the heat transfer surface incorporating surface enhancements, the surface enhancements can contact the outer layer to, for example, maintain the relative position of the heat transfer surface and the outer layer. The subject condenser can allow the flow of refrigerant in ducts or channels such that the refrigerant is in thermal contact with the heat transfer surface and the flow of the refrigerant is substantially parallel with the heat transfer surface. Accordingly, in a specific embodiment, the refrigerant flows substantially parallel to the curve of the heat transfer surface and the external fluid flows substantially parallel to the curve of the heat transfer surface, such that the refrigerant and the external fluid are flowing in substantially parallel curves. In a specific embodiment, while flowing in these substantially parallel curves, the refrigerant and external fluid can be flowing substantially perpendicular to each other. These embodiments of the subject condenser can be incorporated into the subject cooling system.

In a further specific embodiment, the subject condenser can be tubular in shape with the heat transfer surface being on the outside of the tubular condenser. The tubular shaped condenser can then have a first end and a second end. The condenser can have a second surface on the inside of the tubular condenser such that a volume is created by the second surface to the inside of the tubular condenser. This volume can, for example, house elements of a cooling system in accordance with the subject invention. The tubular shaped condenser can have a circular, square, rectangular, polygonal, hexagonal, oval, peanut, or other cross sectional shape. With respect to an embodiment of the tubular shaped condenser, a means for flowing an external fluid across the heat transfer surface can incorporate a fan located at a first end of the tubular shaped condenser which flows air from the first end to the second end, or vice versa, across the heat transfer surface. The fan can also flow air from the first end to the second end of the tubular condenser through the volume formed by the second surface of the condenser so as to, for example, cool other components of a cooling system housed in the volume surrounded by the second surface of the condenser. Such a flow of external fluid from the first end to the second end of the tubular condenser can also allow the transfer of heat from the second surface to the external fluid.

DETAILED DESCRIPTION OF THE INVENTION

The subject invention pertains to a method and apparatus for cooling. In a specific embodiment, the subject invention relates to a lightweight, compact, reliable, and efficient cooling system. The subject system can provide heat stress relief to individuals operating under, for example, hazardous conditions, or in elevated temperatures while wearing protective clothing. The subject system can be utilized in other applications that can benefit from this type of cooling system. The performance of this system cannot be matched simply by using smaller versions of currently available designs.

The subject invention also relates to a condenser for transferring heat from a refrigerant to an external fluid in thermal contact with the condenser. The subject condenser can have a heat transfer surface and can be designed for an external fluid, such as air, to flow across the heat transfer surface and allow the transfer of heat from heat transfer surface to the external fluid. In a specific embodiment, the flow of the external fluid is parallel to the heat transfer surface. In another specific embodiment, the heat transfer surface can incorporate surface enhancements which enhance the transfer of heat from the heat transfer surface to the external fluid. In another specific embodiment, an outer layer can be positioned above the heat transfer surface to create a volume between the heat transfer surface and the outer layer through which the external fluid can flow. Such an outer layer can be thin to keep the weight of the system down. A portion, or all, of the outer layer can be thermally insulating, for example for use in cooling systems in contact with a person's skin or clothing. Alternatively, the outer layer can be thermally conducive to assist in thermal transfer to the environment. In an embodiment with the heat transfer surface incorporating surface enhancements, the surface enhancements can contact the outer layer to, for example, maintain the relative position of the heat transfer surface and the outer layer. The subject condenser can allow the flow of refrigerant in ducts or channels such that the refrigerant is in thermal contact with the heat transfer surface and the flow of the refrigerant is substantially parallel with the heat transfer surface. Accordingly, in a specific embodiment, the refrigerant flows substantially parallel to the curve of the heat transfer surface and the external fluid flows substantially parallel to the curve of the heat transfer surface, such that the refrigerant and the external fluid are flowing in substantially parallel curves. In a specific embodiment, while flowing in these substantially parallel curves, the refrigerant and external fluid can be flowing substantially perpendicular to each other. These embodiments of the subject condenser can be incorporated into the subject cooling system.

Figure 8B:
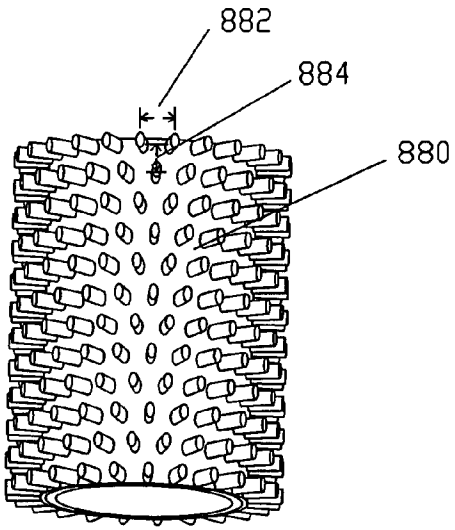
FIG. 8B shows the condenser shown in FIG. 8A with the inner wall piece inserted into the outer wall piece to form a refrigerant annulus.

In a specific embodiment, the subject invention relates to a condenser having a tubular body. The subject tubular condenser can have a variety of cross sectional shapes, such as, but not limited to, circular, rectangular, square, polygonal, hexagonal, oval, peanut, or other shapes conducive to the specific use of the system. The tubular shape of the subject condenser can allow other components of a cooling system of which the condenser is part to be located, at least partially, within the volume created by the inner surface of the condenser. In this way, an external fluid such as flowing air can be brought in thermal contact with the condenser to remove heat from the condenser. Referring to FIG. 8B, the condenser can incorporate means for enhancing heat transfer between the condenser and the external fluid. In a specific embodiment, a fan or other means for generating flowing air can urge air to flow along the heat transfer surface and/or means for enhancing heat transfer between the condenser and the flowing air such that the flowing air starts at a first end of the tubular condenser and exits at the other, or second, end of the tubular condenser.

Figure 11A:
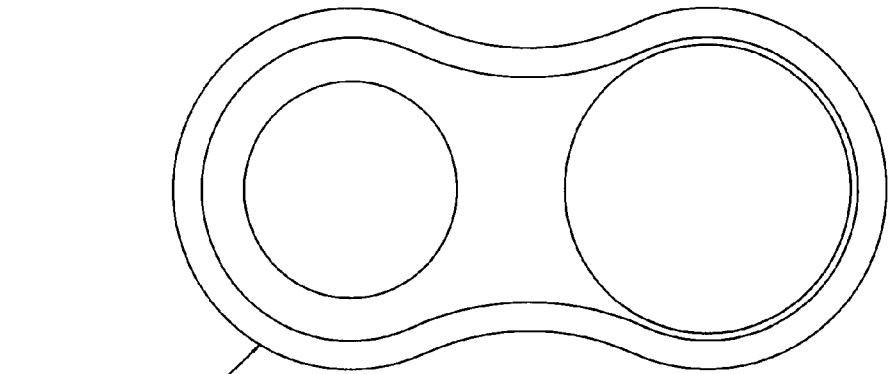
FIG. 11A shows an embodiment of the subject invention having two fans and the battery within the condenser inner walls.
Figure 11B:
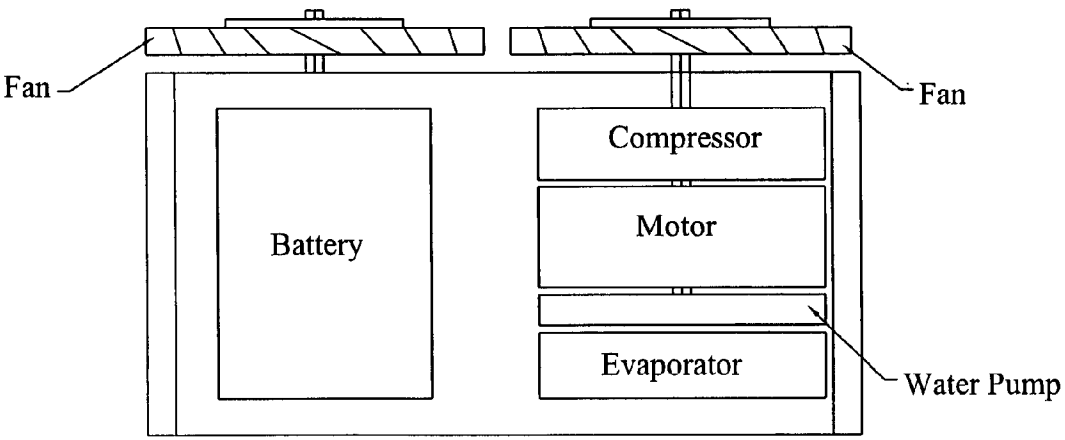
FIG. 11B shows a cross section of the embodiment shown in FIG. 11A, showing a "peanut" shaped cross section of the condenser walls with the battery, compressor motor, and evaporator within the inner condenser walls.

Such a flow path can allow a user to conveniently wear the subject cooling system on the user's body as the flowing air exits the subject cooling system to be directed parallel to the users body while allowing intake of air at the first end unobstructed by the user. In a specific embodiment, the tubular condenser can be contoured to lie against a users body and can house the remaining components of the cooling system within a volume created by an inner surface 800 of the condenser. FIGS. 11A and 11B show an embodiment of the subject cooling system where the battery, compressor, motor, water pump, and evaporator are housed within the condenser, in a volume created by the inner surface 800 of the condenser. In this embodiment, FIG. 11A shows a cross section from the top and FIG. 11B shows a cross section from the side. As shown in FIGS. 11A and 11B, the fans produce a flow of air which travels through the shell, or annular volume, of the condenser formed between the heat transfer surface 880 of the condenser and an outer wall, or outer layer 10, of the condenser. Another portion of the flowing air produced by the fans can travel through the portion of the condenser housing the battery, compressor, motor, and evaporator and remove heat from these components. In the embodiment show in FIGS. 11A and 11B, the compressor, motor, evaporator, and battery are each cylindrical in shape. Other shapes for one or more of these components can also be used.

The use of cylindrical components as shown in FIGS. 11A and 11B can also enable the use of a condenser with a substantially cylindrical shape with the battery within the same cylindrical volume as the compressor, motor, and evaporator. Alternatively, one or more components, such as the battery can be outside of this volume created by the condenser. In addition, a portion of one or more components can extend out from the volume created by the condenser.

In a specific embodiment, the subject microclimate system can remove at least about 120 watts of heat while consuming less than about 50 watts of power, and weigh less than about 6 pounds while having less than about a 1000 cubic centimeter volume. In a further specific embodiment, the subject cooling system can remove at least about 300 Watts of heat while consuming less than about 100 Watts of electrical power, and can weigh less than about 3.5 pounds (not including the water jacket or the power source) within a volume of less than about 1500 cc or 1.5 L. In a specific embodiment, the subject system can run for at least about 4 hours or more with the use of batteries. In a specific embodiment, a cooling power to weight ratio of more than 28 W/lb and/or a volume to cooling power ratio of less than 15 cc/W can be achieved utilizing a vapor compression cycle with cooling capacities lower than 500 W.

A cooling cycle for an embodiment of a microclimate cooling system in accordance with the subject invention can incorporate a vapor compression cycle intended for use with compressible refrigerants. There are four basic features to such a vapor compression cycle. The cycle begins with a compressor that compresses refrigerant vapor to a pressure at which the corresponding vapor temperature is above the ambient temperature of the condenser. The compressed hot refrigerant vapor flows to a condenser that is typically a gas to vapor or liquid to vapor heat exchanger where the vapor is hotter than the gas or liquid. Heat is removed from the compressed refrigerant vapor by the ambient fluid on the other side of the heat exchanger. This causes the temperature of the compressed vaporized refrigerant to decrease below the saturation temperature of the refrigerant and the vapor condenses to liquid. The high pressure liquid can then be expanded through an expansion device, such as a throttling valve, which can cause a rapid decrease in refrigerant pressure after the valve. The lower pressure can cause the temperature of the liquid coolant to drop to, for example, the corresponding saturation temperature.

In a specific embodiment, the cool liquid refrigerant can then flow through an evaporator that allows the liquid refrigerant to absorb the heat from a fluid which is desired to be cooled. The evaporator can act as another heat exchanger with cool refrigerant on one side and the fluid, either liquid or gas, that is desired to be cooled on the other side of the heat exchanger. The absorption of heat in the evaporator causes the liquid refrigerant to boil. The vaporized refrigerant then flows back into the compressor to begin the cycle again. In an alternative embodiment, the evaporator can be in thermal contact with a heat source, such as a metal plate, so that as the refrigerant flows through the evaporator heat is transferred from the heat source to the refrigerant. In a specific embodiment, the embodiment shown in FIG. 5 can be modified so that the evaporator 700 protrudes from the bottom of the condenser and can make thermal contact with a heat source to be cooled.

Figure 9A:
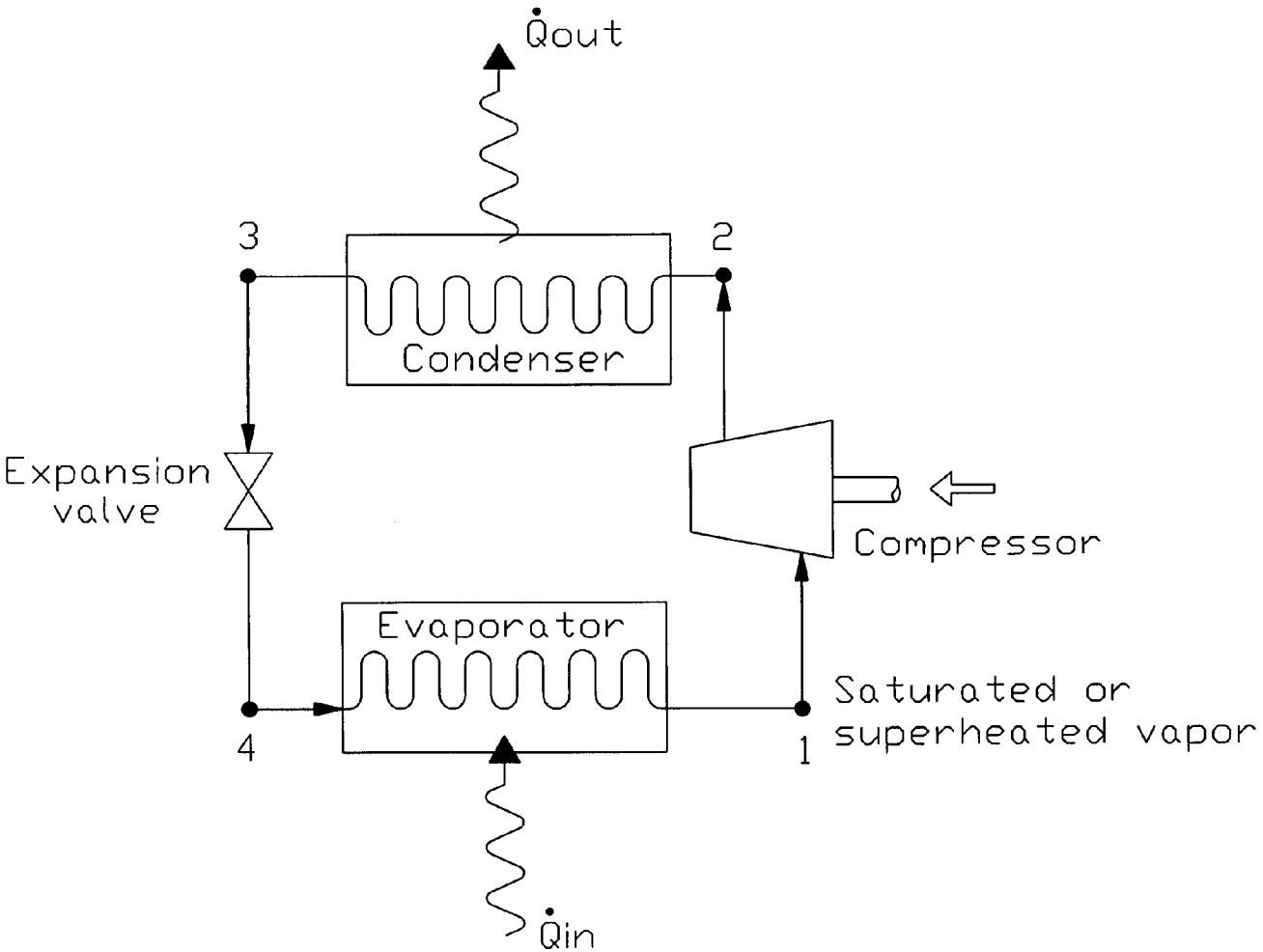
FIG. 9A shows a schematic of a cooling system in accordance with the subject invention, incorporating a condenser, an expansion valve, an evaporator, and a compressor.
Figure 9B:
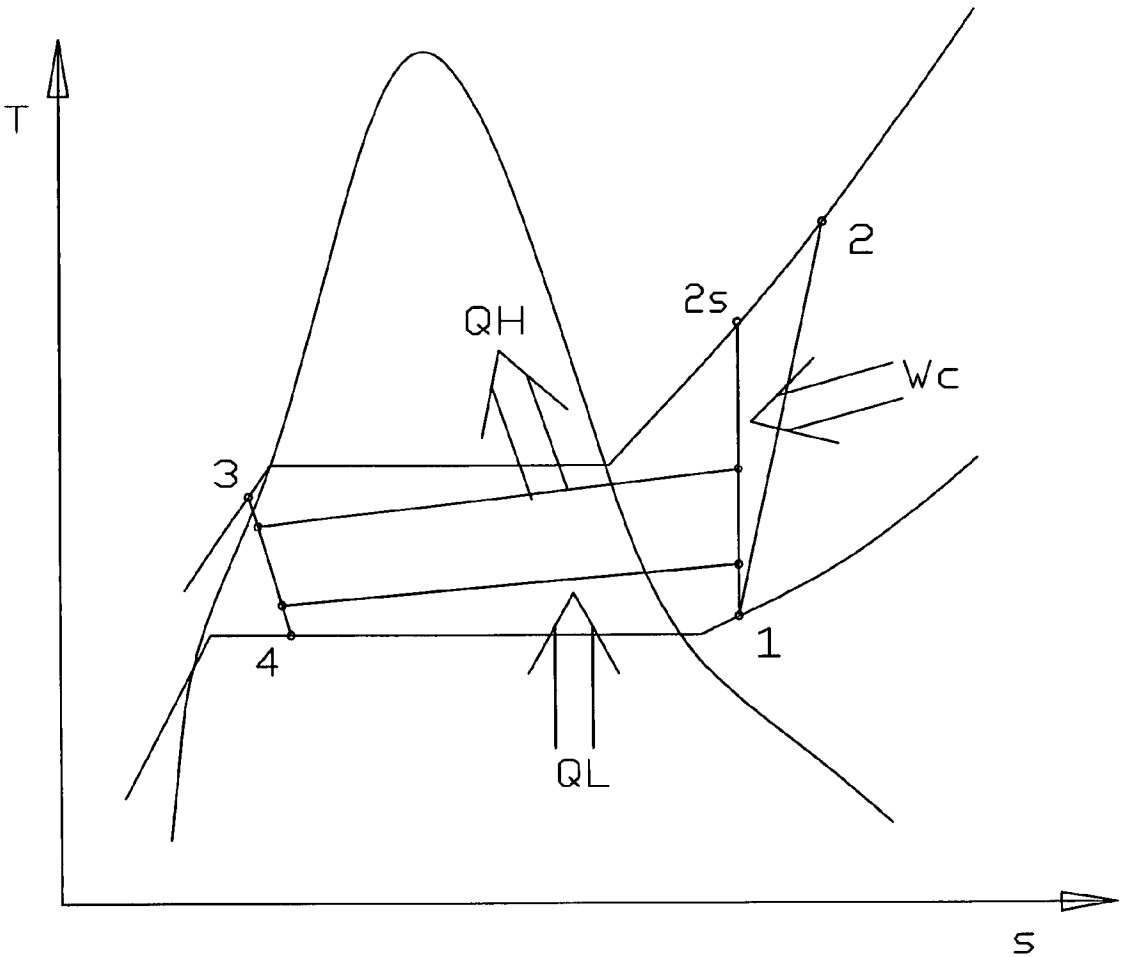
FIG. 9B shows a basic vapor compression cycle temperature/entropy diagram.

In a specific embodiment, the subject invention can allow the use of the standard vapor compression cycle in a compact and lightweight design by utilizing specialized components that have been developed specifically for the subject system. FIG. 9A shows a schematic of a cooling system in accordance with the subject invention, incorporating a condenser, an expansion valve, an evaporator, and a compressor. FIG. 9B shows a basic vapor compression cycle temperature/entropy diagram. The points 1, 2, 3, and 4 in the cooling cycle of the cooling system of FIG. 9A and the temperature/entropy diagram of FIG. 9B correspond with each other. Referring to FIG. 9B, a compressor intakes cool, low pressure vapor refrigerant at point 1. An isentropic compression would discharge hot high pressure refrigerant vapor at point 2*s*. However, compressors are not 100% efficient and, therefore, typically exhaust superheated vapor at point 2. The hot, high pressure refrigerant vapor transfers its heat via a heat exchanger, also known as a condenser, to an external fluid. As the hot, high pressure vapor refrigerant cools from point 2 to point 3, it condenses to warm high pressure liquid refrigerant. An expansion device located between points 3 and 4 allows the warm high pressure liquid coolant to become a cold low pressure mixture of refrigerant vapor and liquid. The cold low pressure refrigerant then flows to another heat exchanger, typically called an evaporator, to remove heat from, for example, another external fluid. Alternatively, the evaporator can be in thermal contact with a heat source such heat is transferred from the heat source to the refrigerant which is in thermal contact with the evaporator without the use of a second external fluid. This heat transfer causes the low pressure liquid coolant to vaporize, shown in FIG. 9B between points 4 and 1, and becomes cool low pressure refrigerant vapor. Each of the cycle component designs can take size and weight into account.

Figure 1A:
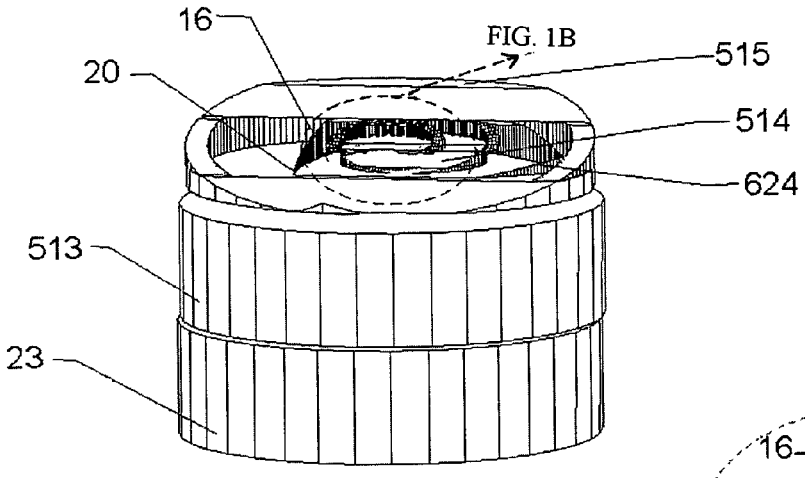
FIG. 1A shows an embodiment of the subject invention.
Figure 1B:
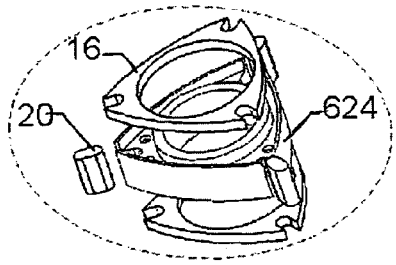
FIG. 1B shows an expanded view of a rotor of a compressor incorporated with the embodiment shown in FIG. 1A.
Figure 6:
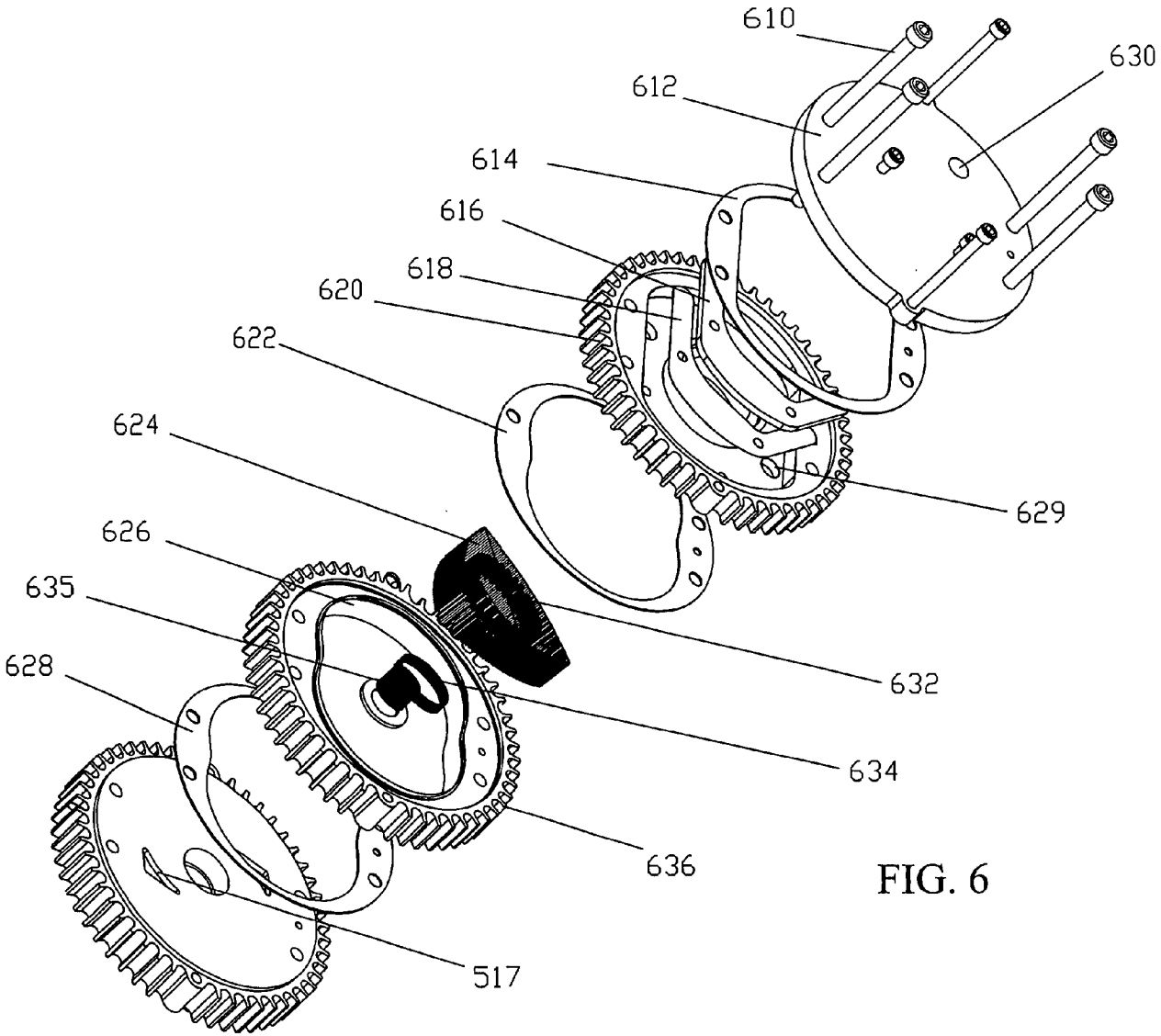
FIG. 6 shows an exploded view of a specific embodiment of a compressor in accordance with the subject invention.

In a specific embodiment, the subject invention can incorporate compressor 515, shown in FIG. 1A. FIG. 6 shows an exploded view of certain portions of compressor 515 shown in FIG. 1B. Compressor 515 can utilize a positive displacement means to compress the refrigerant vapor entering the compressor. A positive displacement means can start wit a certain volume of refrigerant vapor and reduce the volume by a set amount resulting in compressed refrigerant vapor. The amount of volume change can be a function of the geometry of the positive displacement means. Valves and upstream conditions typically govern the pressure at which the vapor leaves the compressor. The positive displacement means can be, for example, a piston style, a sliding vane, a screw, a scroll, or a rotary lobed type. In a specific embodiment, compressor 515 can incorporate a rotary lobed type positive displacement means. An example of this type of compressor is shown in FIGS. 1 and 6, and can be referred to as a rotary lobed compressor. The purpose of the compressor is to intake low pressure, low temperature refrigerant vapor and discharge high temperature high pressure vapor to the condenser.

Referring to FIGS. 1 and 6, the configuration shown can be referred to as a Wankel compressor. The compressor can incorporate a substantially triangular shaped rotor 624 which spins on an eccentric shaft 634. In a specific embodiment, the compressor can use a 3/2 gear ratio for positioning (Ogura, Ichiro, "The Ogura-Wankel Compressor—Application of a Wankel Rotary Concept as Automotive Air Conditioning Compressor," SAE Technical Paper 820159, SAE 1982). The gears 632 are used to position the rotation of the rotor through its eccentric path. The rotor rotates inside of a peanut shaped epitrochoid chamber 626. Such a rotor positioning results in the compressor exhibiting two complete compressions per revolution.

The shape of an epiterchoid chamber is determined by the following equations:

$$x(t) = \frac{3}{7} \cdot MA \cdot \cos(t) - \frac{1}{14} \cdot MA \cdot \cos(3MA \cdot t)$$

$$y(t) = \frac{3}{7} \cdot MA \cdot \sin(t) - \frac{1}{14} \cdot MA \cdot \sin(3MA \cdot t)$$

where MA is the major axis.

Figure 12:
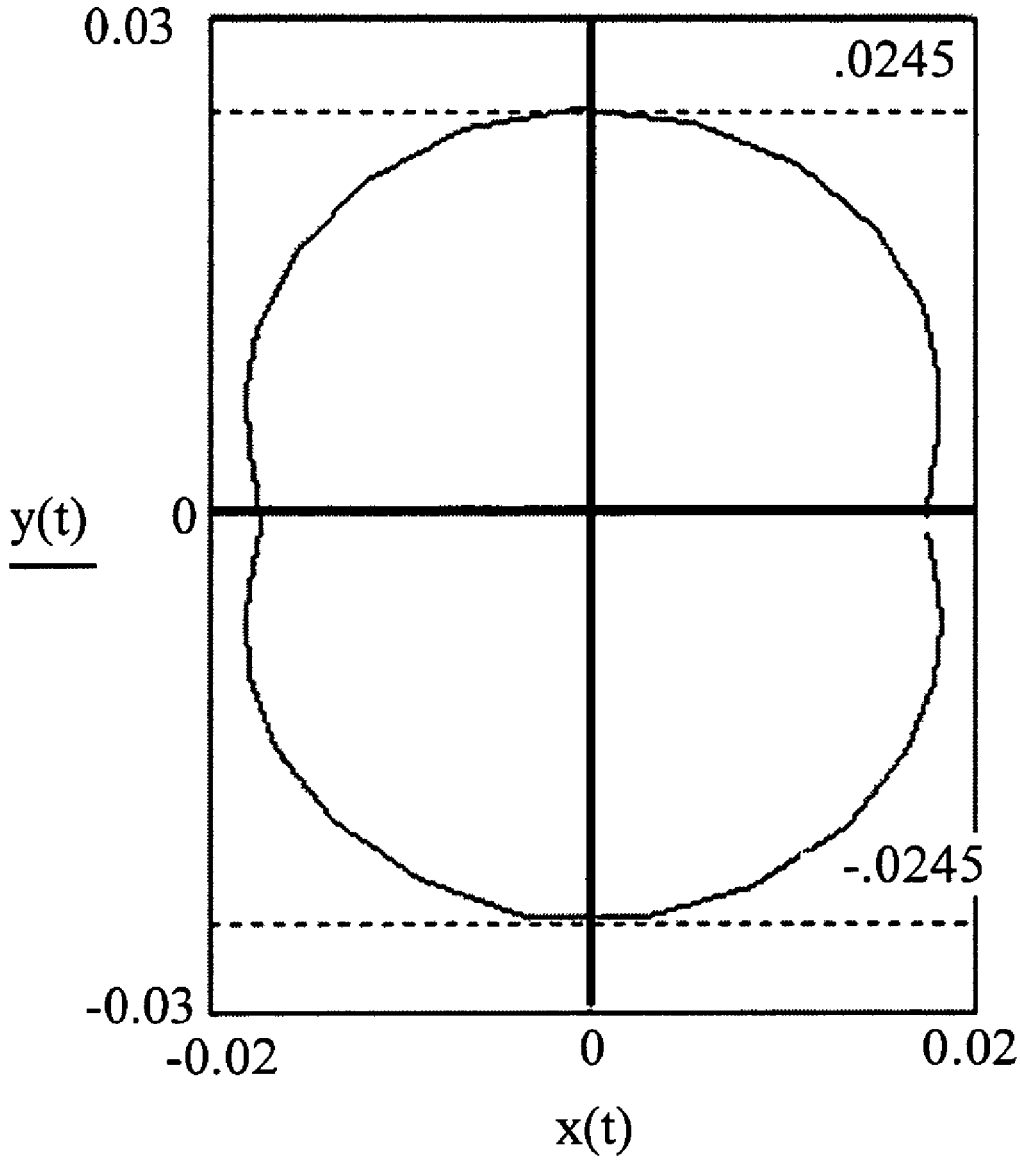
FIG. 12 shows an example of epiterchoid shape, which a compressor chamber can incorporate in a specific embodiment of the subject invention.
Figure 13:
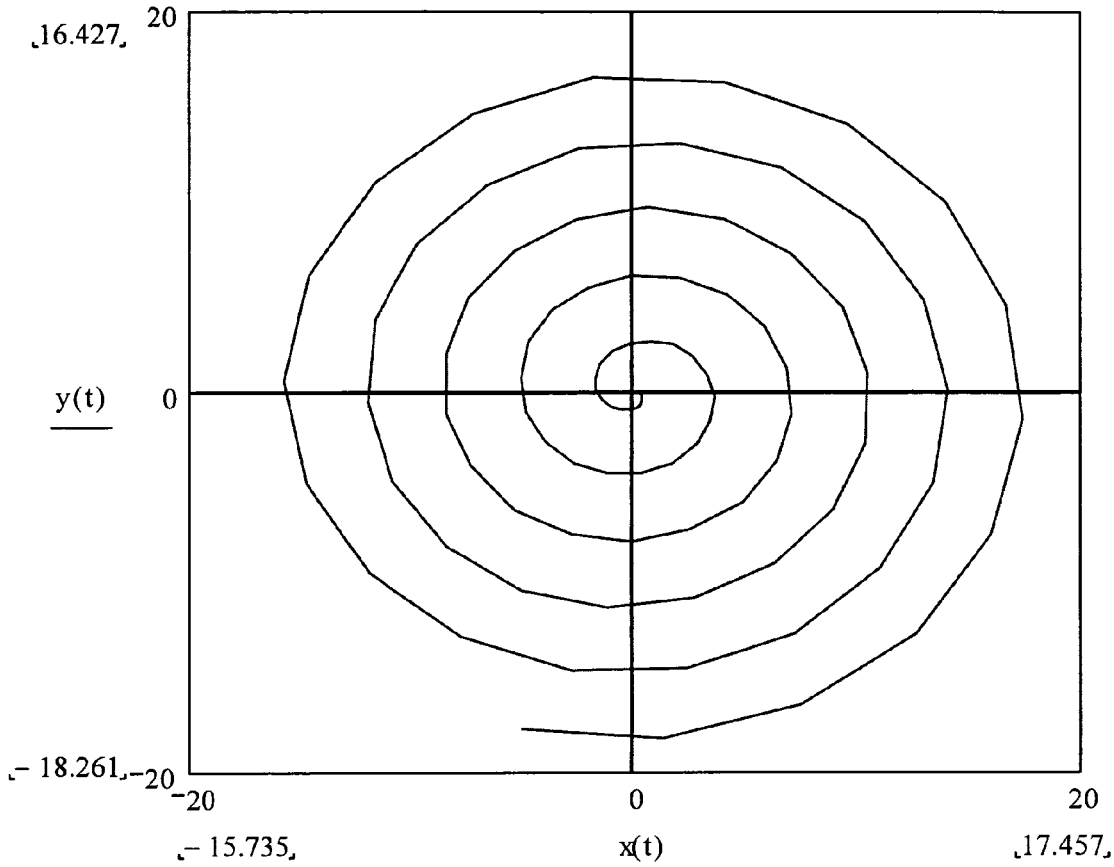
FIG. 13 shows an Archemidian spiral corresponding to a fluid path within an evaporator in accordance with a specific embodiment of the subject invention.

In a specific embodiment, a length of 49 mm can be utilized for the major axis of the epitrochoid with a height of 6 mm. Using the above equations, an epiterchoid shape, which is framed in a Cartesian coordinate system, is found to have the shape shown in FIG. 12. The values of the major axis and height can be modified based on the cooling capacity requirements of the vapor compression cycle and the desired angular velocity of the compressor. Once these two constraints are set, the basic designs of the main components of the compressor can be determined as a function of the geometry. The major axis determines the size of the rotor and the shape of the epitrochoid, as well as the gears that are used in the compressor.

Using the equations relating to the shape of the epiterchoid chamber suggested above, the rotor size and shape can also be chosen. Finally, the geometric height of the epiterchoid and rotor can be determined by the amount of fluid that is desired to be displaced on each revolution. After having calculated these dimensions, the compressor's speed can be chosen to determine the displacement per unit time or volumetric flow rate. In a specific embodiment, incorporating an epiterchoidal chamber with a major axis of 49 mm and a height of 6 mm, a speed of 1200 rpm is chosen to provide a mass flow rate of approximately 1 g/s of vapor refrigerant 134a at an inlet pressure of 57 psia.

The flow through the compressor can be controlled by inlet port 517 (shown in FIGS. 5 and 6) and valved exhaust ports 629 (shown in FIG. 6). In a specific embodiment, a triangular inlet port 517 design based on the rotational path of the rotor can be used on the bottom face of the compressor. Although a triangular shaped port is shown here, other shapes such as oval, round, and square can also be used. This design can allow the cool refrigerant vapor into the compressor. Rotor 624 can then travel over the top of the intake port so as to close the intake port as rotor 624 begins to compress the refrigerant vapor. This design feature can eliminate the need for an intake check valve, typically used by positive displacement compressors. Exhaust valve 618 and valve stop 616 can be placed on the top face of the compressor and positioned on top of the exhaust port 629 to allow for the maximum compression to occur. The exhaust valve is a check valve that can prevent hot high pressure refrigerant vapor from flowing backwards into the compressor. In a specific embodiment, cantilevered flapper valves can be used to reduce the amount of space required for the outlet port 629.

To reduce the vibrations caused by the mass of the rotor spinning eccentrically in the compressor, a counter balance 635 can be placed on the main shaft. A second rotor can be used to balance the compressor. In embodiment the second rotor can be positioned 180° out of phase with the first rotor so as to counter balance the rotating force. The addition of the second rotor adds complexity to the compressor, but can double the mass flow rate for a given RPM speed. Shaft seals and bearings can be used along the shaft to assist in sealing and to absorb the loads caused by the rotating parts. External sealing can be achieved by the shaft seals and gaskets 614 and 628 while internal sealing of the compression chambers can be accomplished using, for example, a sealing gasket 622 or o-ring.

To increase the efficiency and life of the compressor, referring to FIG. 1B, spring loaded face seals 16 and/or spring loaded tip seals 20 can be installed on the rotor. The face seals 16 and tip seals 20, as shown in FIG. 1B, can be designed to minimize leakage between the chambers during the rotary motion of the rotor. In a specific embodiment, the seals can be made of a low friction material to minimize wear and friction losses. In a further specific embodiment, an engineered plastic material such as PEEK, TEFLON, NYLON, or DELRIN can be used. Other materials with similar characteristics can also be used. The tip seals and face seals are spring loaded to insure that the plastic seals stay in contact with the metal surfaces of to compressor housing. In a specific embodiment, the springs used are 2.4 mm in diameter, 6.2mm long, have a spring stiffness constant of 2.2 lbs per inch, and a pitch of 35 coils per inch. Preferably, at least one spring is used on each of the tip seals. Multiple springs can be used on the face seal in order to provide an even spring loading force. In further embodiments, the spring force can be produced by other means such as wave springs, elastic rubbers, or gas filled balls. Preferably, the tip and face seals are fabricated so that a slip fit into the rotor can be maintained. In a specific embodiment, a slip fit dimensional tolerance of 8 micron is used.

Additional methods of sealing may be considered for the compressor as well. Rather than face sealing with gaskets and spring loaded plastics, sufficient sealing can be created by machining the parts with very high precision. In a specific embodiment, the gaps between the rotor and the upper or lower walls are machined to fit to within 0.0005 inches so that the fluid being pressurized has significant difficulty in leaking past the two surfaces.

Figure 5:
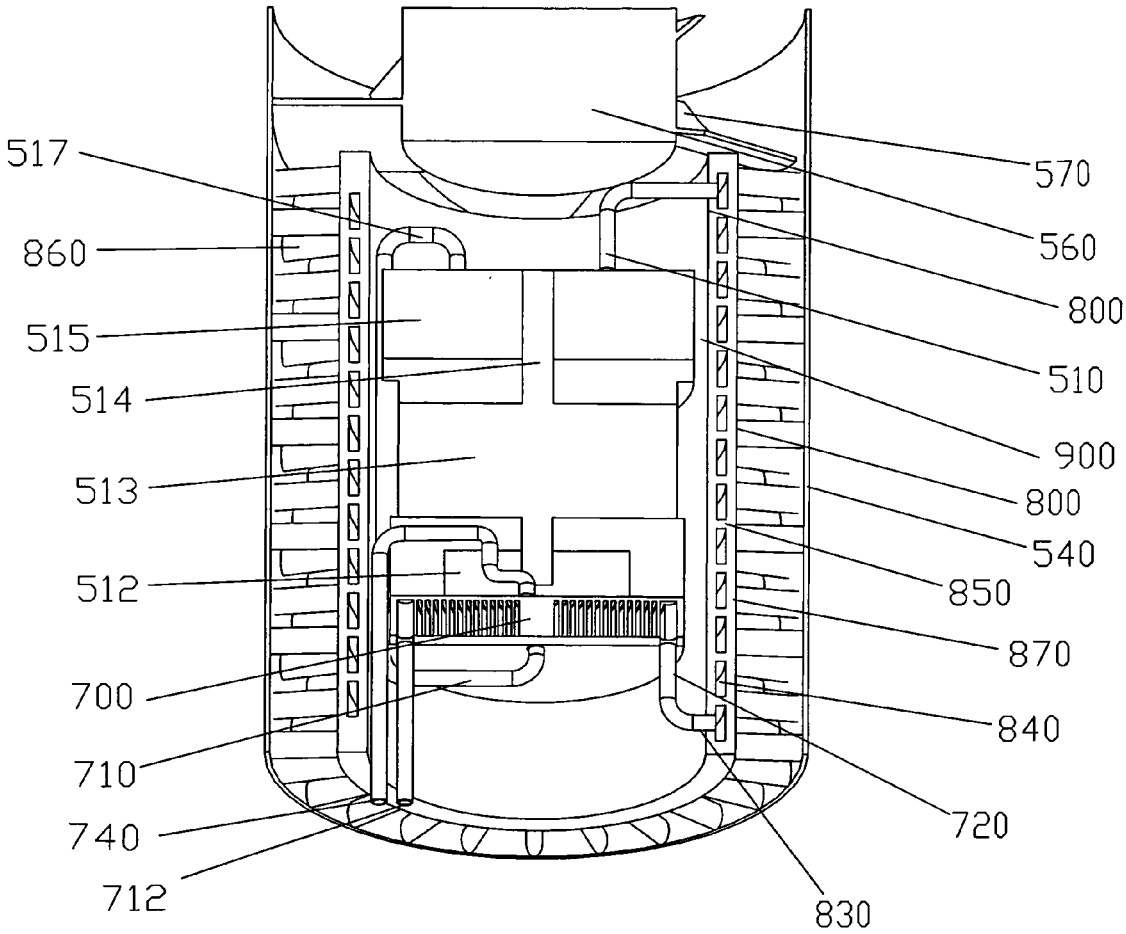
FIG. 5 shows an embodiment of the subject invention, illustrating connections between various parts which allow liquids and/or gases to enter and/or exit the various parts.

End plates 612 and fasteners 610 can seal the compressor compartment. To aid in cooling the compressor, cooling fins 636 can be added to the outside housing of the compressor. Cooling fins 636 can be designed to increase the surface area of the outside housing to improve heat transfer out of the compressor housing. Cooling fins 636 can have a variety of shapes. In a specific embodiment, the cooling fins 636 can have long narrow channels running axially with the compressor. During operation of the subject cooling system, air can be blown past the compressor housing to help cool the internal components. In a specific embodiment, air flow provided by the condenser fan 570 can flow between the condenser inner wall surface 800 and the compressor 515 outer wall in space 900, for example as shown in FIG. 5. This air then comes in contact with the compressor cooling fins 636. The number of fins and the size and shape of the fins can be chosen to enhance the cooling effect provided by air flowing over the fins. In one example, the number and size of the fins are chosen to be 48 and 0.25 inches, respectively, in order maximize the Nusselt number of the fluid flowing past the fins. The Nusselt number is directly proportional to the amount of heat transfer between the solid surface and the fluid and is known as:

$$Nu = 1.86 \cdot \left( \frac{Re \cdot Pr}{\frac{w}{D_h}} \right)^{\frac{1}{3}} \cdot \left( \frac{\mu}{\mu_s} \right)^{.14}$$

Where Re is the Reynolds number, Pr is the Prandtl number, w is the channel width, $D_h$ is the hydraulic or effective diameter, $\mu$ is the bulk fluid viscosity, and $\mu_s$ is the fluid viscosity at the heat transfer surface.

Figure 10:
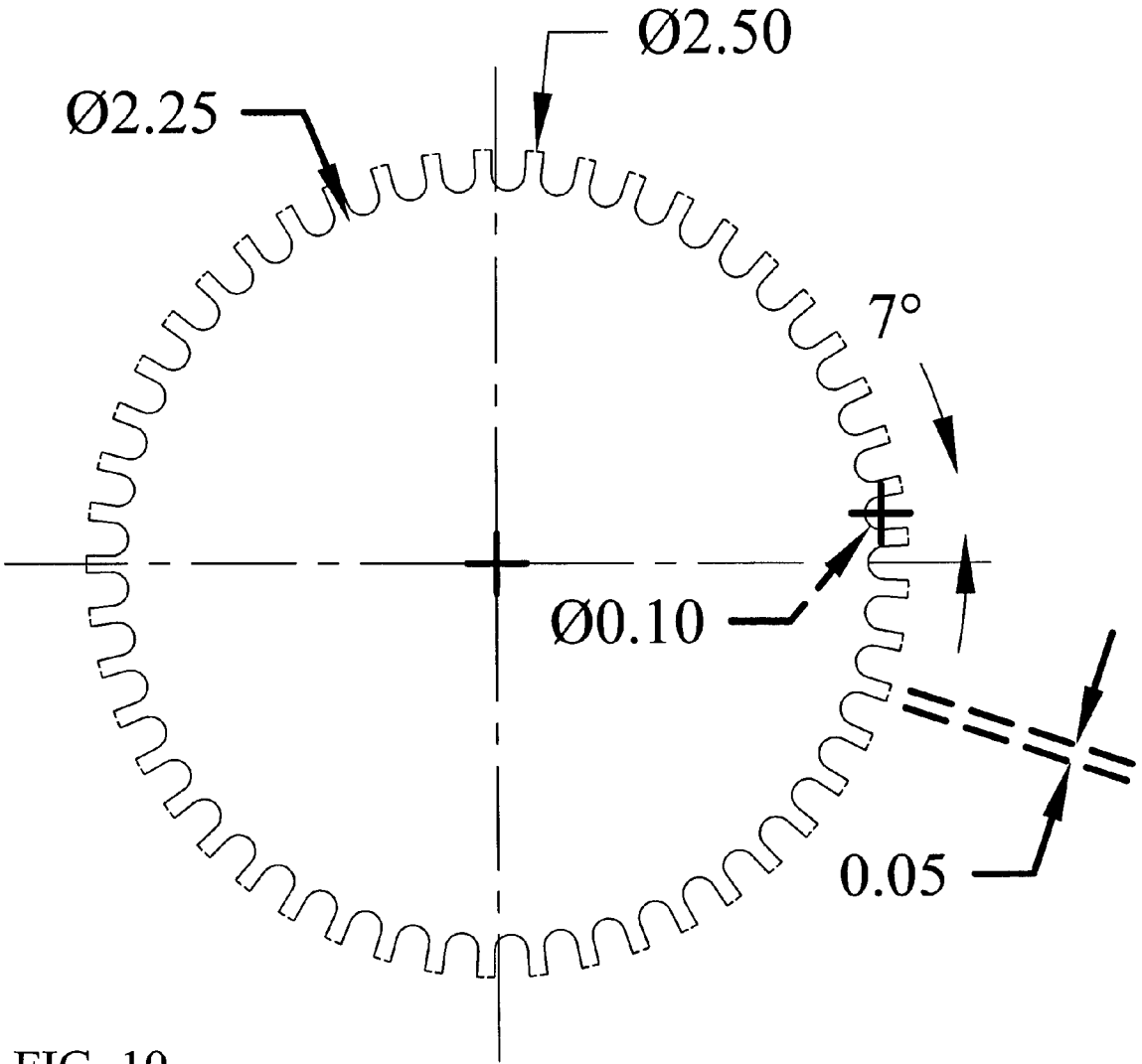
FIG. 10 shows the cross-section of a fin design for a compressor in accordance with the subject invention.

For a specific embodiment of a compressor in accordance with the subject invention incorporating an epiterchoidal chamber with a major axis of 49 mm, a cross-sectional geometry shown in FIG. 10 was chosen.

This direct cooling of the compressor can aid in the thermodynamic cycle shown in FIG. 1, by reducing the superheat of the vapor between points 2 and 2*s*. Typical vapor compression cycles remove the heat from the compressor via the internal flow of the refrigerant. This increases the heat load of the vapor compression cycle and reduces cycle efficiency. The subject compressor can incorporate low friction, low corrosion materials. In addition, wear parts other than the seals can be coated with low friction, high hardness coating, such as diamond like carbon, TiN, and $MoSi_2$. In a specific embodiment, the subject compressor can operate without coolant oil. Compressor oil can reduce the heat transfer performance of the condenser and evaporators, requiring a larger heat exchanger to properly transfer heat. Accordingly, the use of a specific embodiment of the subject compressor which can operate without oil can allow the use of a smaller heat exchanger.

The motor 513, as shown in FIG. 1A, can be used to power the drive shaft 514. In a specific embodiment, motor 513 can be a permanent magnetic synchronous motor. Other mechanical devices capable of producing shaft power can also be used to power the subject compressor, including, for example, combustion engines, wind, or paddlewheels. In a specific embodiment, the motor can be designed for long service life and can operate at much higher efficiencies than standard motors. The motor design can be a compact unit specially suited for this type of application. The motor can deliver a high power density and operate at variable speeds through a motor controller 23. The incorporation of motor controller 23 can allow the motor to change the amount of compression, depending on the cooling load. Standard vapor compression cycles typically turn the compressor on and off in order to adjust to the net cooling requirements of the cooling load. The turning of the compressor on and off can reduce the efficiency of the cooling system, as the start up interval of a motor can be extremely inefficient. Accordingly, the use of a control feature, in a specific embodiment of the subject invention, can allow the variation of the speed of the motor, rather than intermittent operation of the motor, to adjust the cooling system to the net cooling requirement of the cooling load so as to significantly improve the energy efficiency of the cycle. In a specific embodiment, the motor can provide 41 Watts of shaft power, provide 36 oz-in torque, weigh approximately 22 ounces, have a diameter of 2.25 inches, and have a maximum efficiency of 82%.

The subject cooling system can be powered by, for example, batteries, AC power, and/or fuel cells. An embodiment powered by batteries can connect to external battery packs or can utilize a central power unit.

Figure 2:
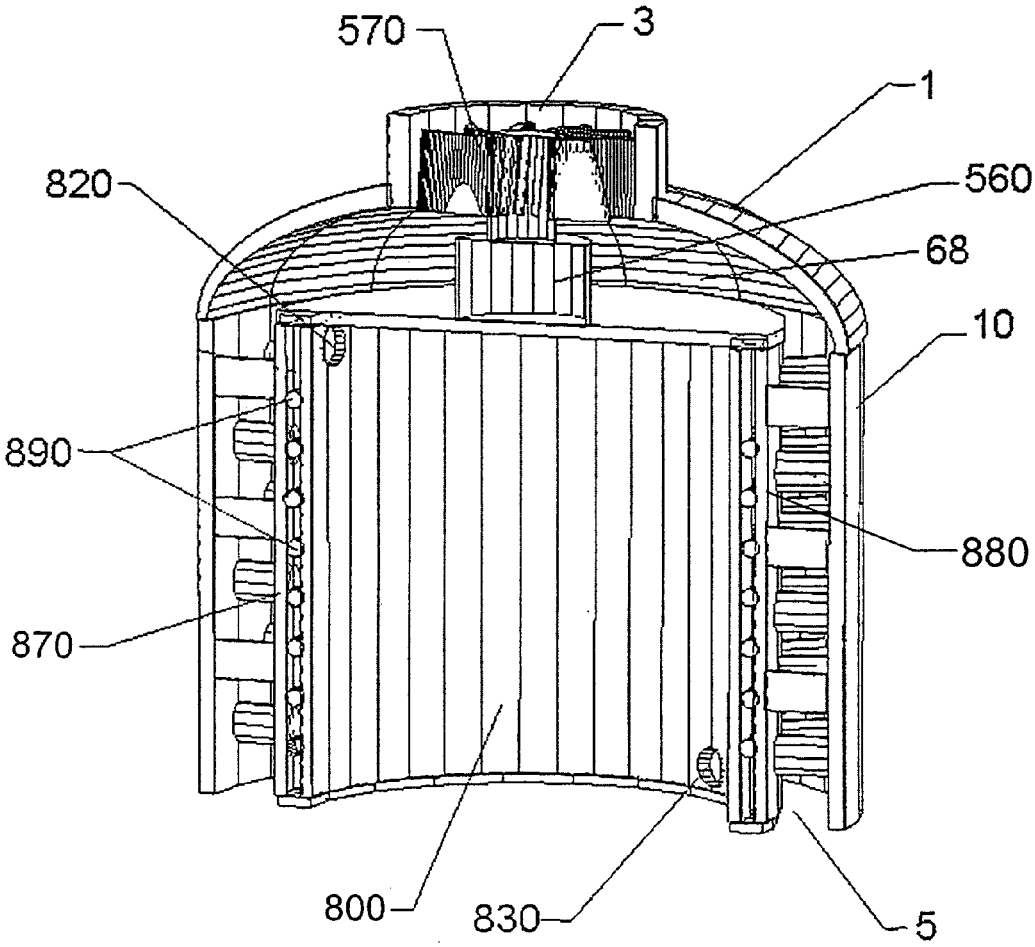
FIG. 2 shows a view of the interior of an embodiment of the subject invention, illustrating an annular region for hot vapor coolant flow and pin fins in thermal contact with the outer wall of the annular region.
Figure 8A:
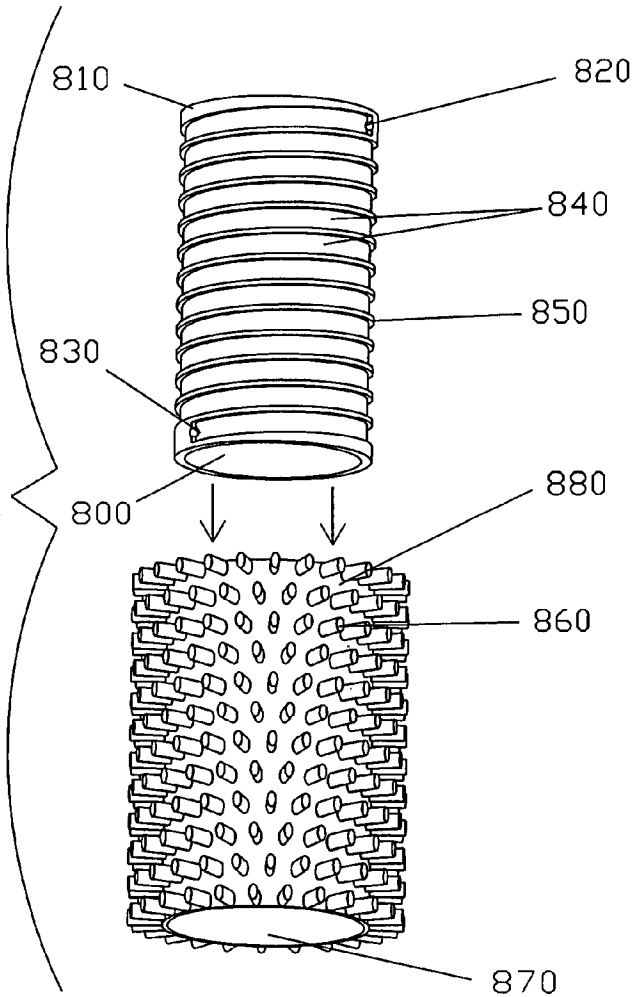
FIG. 8A shows an inner wall piece with a spiral spacer and an outer wall piece with pin fins of a specific embodiment of a condenser in accordance with the subject invention

The compressed vapor refrigerant exiting outlets 630 of the compressor can flow into a condenser inlet port 820, shown in FIGS. 2 and 8A, via connection tube 510, shown in FIG. 5. The condenser can be, for example, a general purpose heat exchanger. On a first side of the heat exchanger the compressed hot refrigerant gas can flow and on a second side of the heat exchanger an external fluid can flow. Typically, ambient air or water can be used on the second side of the heat exchanger. The heat is transferred between the two fluids via dividing wall 870 (shown in FIGS. 2, 5, and 8A) such that an external fluid flowing on the outer surface, or heat transfer surface 880, of dividing wall 870 will remove heat from dividing wall which has absorbed from the refrigerant flowing through the condenser. The design of the subject condenser can involve optimizing the heat transfer between the two fluids flowing on either side of dividing wall 870.

The design of the ambient fluid portion of the heat exchanger can involve maximizing the heat transfer from the heat exchanger to the ambient fluid. A simple design of a heat exchanger can incorporate a smooth surface on the outside of the condenser, which can be, for example, flat or curved. In a specific embodiment, the heat exchanger, or condenser, can reject heat from the compressed refrigerant vapor to ambient air and can have a heat transfer surface 880 with enhanced surface geometry that, in conjunction with an air moving device 570 (shown in FIGS. 2 and 5) can remove the heat more effectively than, for example, a smooth surface positioned in ambient air. This heat transfer process can be modeled by $$q=hA\Delta T$$

where q[W] is the heat removal, h[W/m$^2$K] is the heat transfer coefficient, A[m$^2$] is the area of the heated surface, and ΔT[K] is the temperature difference between the heated surface and the ambient fluid such as air. An optimal design can, therefore, maximize h, A, and ΔT so that the product of the three will yield the largest q given space and power limitations.

The subject cooling system, in order to maintain a reduced size, can modify the surface of the condenser so as to increase A as much as possible without substantially increasing the volume of the cooling device. In a specific embodiment, a large number of small extended surface features 860 can be incorporated with the heat transfer surface 880 so as to increase the total heat transfer surface area without significantly increasing the volume of the cooling device. A variety of extended surfaces can be used in conjunction with the subject device. Examples of such extended surfaces are found in DeWitt, D.P. and Incropera, F.P., *Fundamentals of Heat and Mass Transfer*, John Wiley and Sons, Inc. (1996), which is hereby incorporated herein by reference.

An example of the many different shapes and sizes of extended surfaces 860 which can be utilized by the subject invention is shown in FIG. 2. While designing the addition of extended surfaces, consideration can be made to how they are positioned with respect to one another, and to their shape. The position and shape of the extended surfaces can have an effect on the air flowing past them. The heat transfer coefficient h can be a function of this resulting airflow. Therefore, increasing A with the use of extended surfaces can be done taking into consideration how it will affect h. Finally, consideration can be made to maximizing ΔT. It is desirable to keep ΔT as close to the initial conditions as possible as the ambient air passes by the heated surfaces. The configuration of the air flow device and velocity of the airflow can determine the average ΔT that flows through the condenser. Therefore, while designing extended surfaces to enhance A, consideration can be also given as to how the design of the extended surfaces affect the ΔT.

As discussed, the heat transfer surface 880 can be a smooth, flat or curved, surface or can have extended surface features 860 to increase the surface area without significantly increasing the volume. In a specific embodiment, the extended surfaces can be round, elliptical, square, polygonal, or rectangular fins. For example the extended surfaces can be long fins positioned along the full length of the condenser. In a specific embodiment, the extended surfaces can be a porous material such as expanded copper, aluminum, or carbon. Extended surfaces can increase the surface area by, for example, 2 times more than the base surface area of the heat transfer surface 880. In a specific embodiment, the base surface area is between about 200 and about 500 square centimeters with a surface area increase due to extended surfaces of 2 to 5 times. A further specific embodiment having extended surfaces with respect to a base surface area between about 200 and about 500 square centimeters, with a surface area increase due to extended surfaces of 2 to 5 times, can provide up to 300 watts of cooling. In a further specific embodiment, the bases area is between about 300 and about 400 square centimeters with a surface area increase due to extended surfaces of 2.5 to 4 times and providing between 200 and 250 watts of cooling.

In a specific embodiment, extended surface features 860 can have an elliptical cross section. The elliptical cross section can provide a reduced pressure loss (allowing more air flow) so as to increase h. Examples of the utilization of extended surfaces having elliptical cross sections is given in Li, Q., Chen, Z., Flechtner, U., and Warnecke, H. J., "Heat Transfer and Pressure Drop Characteristics in Rectangular Channels with Elliptic Pin Fins," *Heat and Fluid Flow* 19 (1998) 245–250, which is hereby incorporated by reference. These extended surfaces can then be placed on the outside of the cylindrical cooling device in, for example, a staggered arrangement. Referring to FIG. 8B, in a specific embodiment the extended surfaces can be placed with spacing 884 (in a direction parallel with the flow of air) and spacing 882 (in a direction perpendicular to the flow of air) set to, for example, 2.5 times the equivalent diameter of the ellipse. In a specific embodiment, the length of the elliptical pin is 1.66 cm. To remove 200 Watts of heat, fins 860 with an equivalent diameter of 4.19 mm can be used. An airflow device 570 can be placed at one end of the cylinder to flow air axially past the extended surfaces.

Accordingly, heat can be transferred between the hot compressed vapor refrigerant and an external fluid. In a specific embodiment, heat is transferred from the hot compressed vapor refrigerant to an ambient fluid, such as air or water, on the refrigerant side of the heat exchanger. This heat transfer can involve, for example, a simple flat plate, straight tubing, or a coil of tube that flows the condensing fluid by an air-cooled or liquid-cooled surface. In specific embodiments, condensing fluid can flow through a simple annulus or cylindrical design with a open path from top to bottom, through a series of straight ducts created within the annulus or cylinder, or through one or more spiral wound ducts created around the inside of the annulus or cylinder. The heat removal from the coil can also be calculated by $q=hA\Delta T$ where q[W] is the heat removal, $h[W/m^2K]$ is the heat transfer coefficient, $A[m^2]$ is the surface area of the cooled surface, and $\Delta T[K]$ is the temperature difference between the cooled surface and the refrigerant. The temperature of the refrigerant can drop until it begins to condense, at which point it can remain at a constant temperature until the refrigerant is fully condensed into liquid.

In a specific embodiment, a condenser in accordance with the subject invention can incorporate one or more helical ducts created, for example, by a spiral wound wire tube 890 (shown in FIGS. 2 and 4) or an annulus 840 cut into an insert 810 (shown in FIGS. 5 and 8A). There can be one, or a plurality, n, channel(s) which transport the refrigerant from one end of the condenser to the other end of the condenser. In a specific embodiment with a plurality of channels, each channel can begin at a first end of the condenser and travel parallel to the other channels to the other end of the condenser. In a further specific embodiment, the plurality of parallel channels can spiral from one end of the condenser to the other end such that the refrigerant can travel slower in each channel to traverse the condenser. Referring to FIGS. 8A and 8B, insert, or first element, 810 is inserted into an outer piece, or second element, having dividing wall 870 from which surface extensions 860 extend from heat transfer surface 880, such that lips 850 contact dividing wall 870 to seal the windings of annulus 840 from each other. Vapor refrigerated within the ducts can be in thermal contact with the dividing wall 870. A cylindrical shape can enhance the amount of surface area available for a given volume. The duct can wrap around in a spiraling shape from the top of the cylinder to the bottom. In a specific embodiment, the shape of the tube, annulus, can be rectangular, in order to increase the surface area of the tube walls in contact with the hot vapor refrigerant. In this embodiment, the perimeter of the annulus is $P=2(w+y)$ where w is the width of the channel, or duct, and y is the height. Each channel wraps around the cylinder a given number of times, N, given by $$N = \frac{L_{channel}}{\pi d},$$

where d is the diameter of the cylinder. Since $L_{channel}=f(P, n)=f(w,y,n)$, therefore, $N=f(w,y,n)$, where n is the number of parallel channels wrapping around the cylinder such that refrigerant flows through each of the parallel channels, simultaneously, from the first end of the condenser to the second end of the condenser. Therefore, the length of the coil, assuming 1 mm thickness between passes, will be $$L_{coil}(w,y,n)=N(w,y,n)\cdot(y+1\text{ mm})\cdot n$$

$L_{coil}(w,y,n)$ is set equal to the length of the condenser in order to maximize contact with the air cooled surface. Doing so and solving for w for varying values of y and n and setting a design limit of $\Delta P=1$ psi, in a specific embodiment, the final design is found to be

| n | y [mm] | w [mm] | $L_{channel}$ [m] | N | d[cm] |
|---|---|---|---|---|---|
| 5 | 4 | 0.5 | 1 | 4.61 | 6.9 |

for a cycle load of 200 W.

Further design parameters can take into account the pressure losses from refrigerant flowing through the helical channels. The pressure loss, $\Delta P$, of the internal flow can be calculated to check that the design does not induce excessive inefficiencies to the thermodynamic cycle of the cooling device. Similarly to the heat transfer coefficient, $\Delta P$ can be a function of the flow conditions, the cross sectional geometry, and the length of the tube. Correlations to model the pressure loss may be found in McDonald, A. T., and Fox, R. W., *Introduction to Fluid Mechanics*, John Wiley and Sons, Inc. (2000), which is hereby incorporated herein by reference. Pressure loss can be reduced by reducing the length of the duct, since pressure loss and length can be directly proportional. The length of the duct may be reduced by dividing the flow into multiple ducts. In a specific embodiment, the number of ducts is one continuous channel. In a further embodiment, the number of ducts is 2 or more ducts flowing in parallel.

The fluid that the heat is rejected to can flow through the condenser due to the forces generated by, for example, wind, natural convection, fans, blowers, or compressors. In a specific embodiment, referring to FIG. 2, air can be blown into the condenser via, for example, a fan 570, such that air from air inlet port 3 is blown into the condenser and removes heat from the extended surface features 860. A fan motor 560 can power the fan 570 having one or more fan blades. One or more of the components of the subject cooling system can be located, at least partially and preferably substantially, within the volume created by the inner surface 800 of the condenser. In a specific embodiment, a portion of the air from fan 570 can be blown across the internal components of the subject cooling unit. Referring to FIG. 5, a small gap 900, of size between, for example, about 0.01 inches and about 0.1 inches, between the inside wall of the condenser insert 810 and the internal components can be incorporated to allow direct cooling of the components. By positioning at least a portion of the compressor within the volume created by the inner surface 800 of the inner wall of the condenser and allowing a portion of the air from fan 570 to be blown across the internal components of the subject cooling unit, for example via gap 900, two temperature zones can be created such that the air flowing over the surface enhancements 860 of the heat transfer surface 880 is at a lower temperature than air flowing across the internal components. In a specific embodiment, the inner surface 800 of the inner wall of the condenser can also transfer heat to air flowing within the volume created by the inner surface 800 of the inner wall of the condenser. In a further specific embodiment, inner surface 800 can also incorporate extended surface features similar to heat transfer surface 880.

Cooling the components in this way can increase the performance efficiency of the subject cooling unit as compared with standard vapor compression cycles. The stand and cycle typically involves a compressor held within a housing. The compressor's inefficiency can add heat to the cycle, so as to lower the cooling capacity of the standard unit or necessitate an increase in the amount of power required to achieve a given cooling capacity. Referring to FIG. 6, enhanced external cooling of the subject compressor via fins 636 can improve the cycle efficiency.

Referring to FIG. 2, hot air can exit the condenser via exit port 5. In the embodiment shown in FIG. 2, surface enhancements 860, or fins, protrude from the heat transfer surface 880 of dividing wall 870 where the condenser is then surrounded by an outer layer 10. The extended surface features can contact, and secure in place, outer layer 10 so as to form an annular volume between the heat transfer surface 880 and the outer layer 10. This volume can be used to channel the flow of air produced by fan 570 so the air flows across the heat transfer surface 880 and across fins 860. Although it is preferable to pull air in, flow it through the annular volume, and exit out exit orifice 5, alternative embodiments (not shown) can redirect the flow of air, for example near the second end of the condenser. In a specific embodiment, the outer layer 10 can have apertures near the second end of the condenser and the heat transfer surface can have an extension, such as a flap, which redirects the air toward the apertures in the outer layer 10. Accordingly, this embodiment can be positioned so that the second end of the condenser is on, for example, a flat surface. In a further specific embodiment, the second end of the condenser can be positioned on the surface of a heat source so that the evaporator of the subject cooling device is in thermal contact with the surface of the heat source and heat can transfer from the heat source to the refrigerant in thermal contact with the subject evaporator. In additional embodiments, the outer layer 10 can end before reaching the end of the second end of the condenser and a means for redirecting the air flow can redirect the air away from the heat transfer surface 880 through such an opening in the outer layer. Preferably, the heat transfer surface 880 is a solid surface which prevents the flow of the first external fluid through the dividing wall 870. In alternative embodiments, heat transfer surface 880 can incorporate apertures, slits, or other means for allowing the first external fluid to pass through the dividing wall 870.

Figure 3:
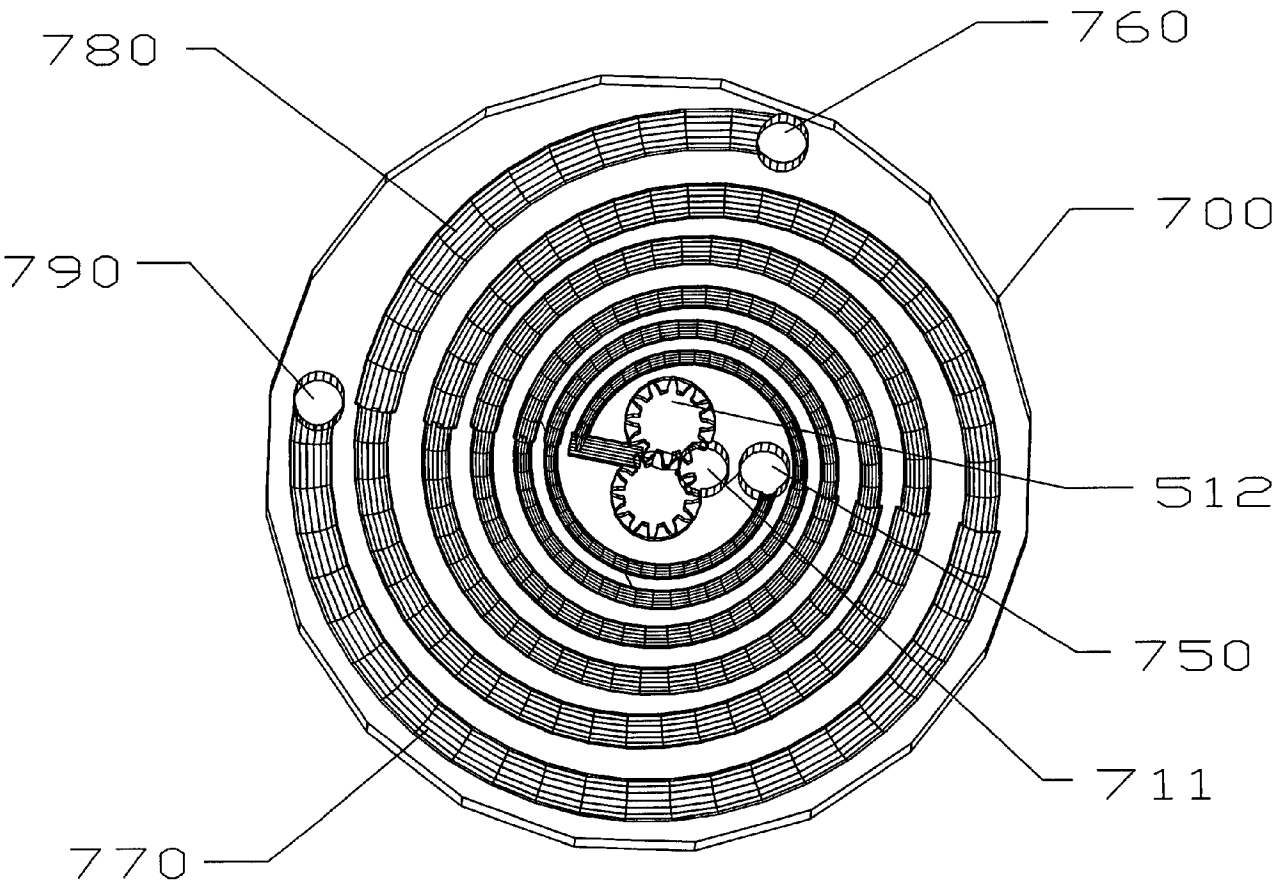
FIG. 3 shows an embodiment of an evaporator in accordance with the subject invention.
Figure 7B:
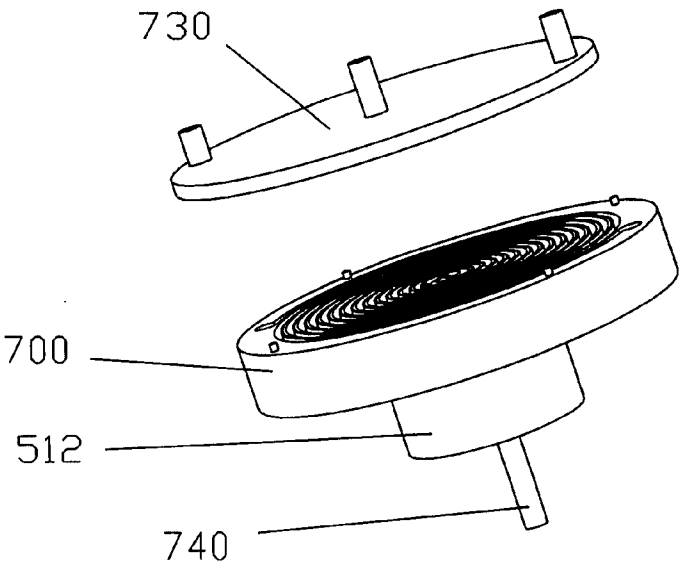
FIGS. 7A and 7B show two views of a specific embodiment of an evaporator in accordance with the subject invention.
Figure 7A:
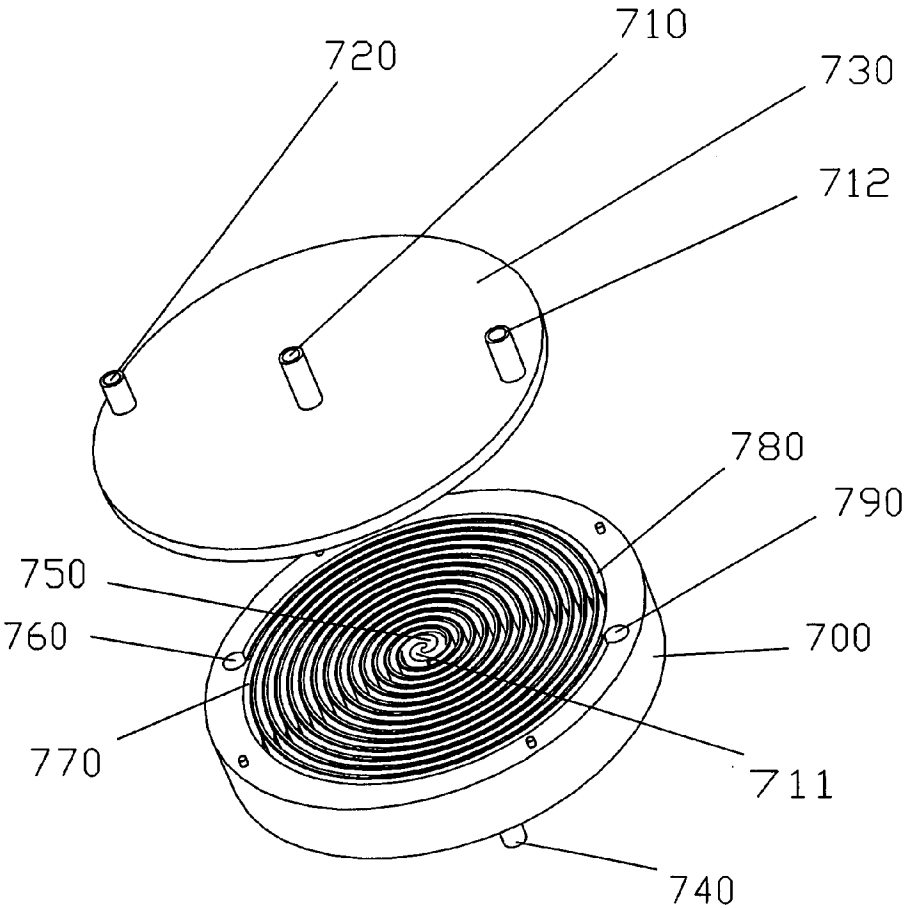

Cool high pressure liquid refrigerant can flow from the condenser 880 via exit port 830 (shown in FIG. 5) into evaporator 700 (shown in FIGS. 3, 4, 5, 7A and 7B). The cooled, compressed liquid refrigerant can travel through connector tube 720 and enter evaporator 700 via, for example, throttle device 760 (shown in FIGS. 3 and 7A). The device can be a simple port design that causes a long restriction to the flow via the port diameter, a capillary tube type, or a commercially available expansion valve that is preset, manually adjustable, electrically controlled, thermally controlled, or controlled by system pressure. A specific embodiment of an evaporator in accordance with the subject invention is shown in FIGS. 3 and 7A. The expanding liquid cools and enters refrigerant evaporation path 780. The refrigerant can exit the evaporator via port 750 and enter a connection tube 710 that terminates at the compressor, for example at compressor inlet port 517. The coolant that is to be cooled can enter the evaporator via coolant connection tube 740 and travel to coolant port 711. A pump 512 can pump the coolant through the cooling path 770. In a specific embodiment, pump 512 is built into the evaporator. Alternatively, a pump external to the evaporator can be utilized. The chilled coolant can exit the evaporator via fluid exit port 790 and flow out of connection tube 712. The coolant type can vary depending on the application and can be, for example, either a liquid or gas. The geometry of the heat exchanging evaporator can vary depending on the type of fluid. In a specific embodiment, the coolant is water. Although the embodiment shown in FIGS. 3 and 7A incorporate counter rotating fluids, the subject invention can also incorporate co-rotating fluids in the evaporator.

The subject evaporator can exchange heat between a coolant and the refrigerant. While the refrigerant passes through the evaporative heat exchanger, it can experience a phase change from liquid to vapor as it picks up heat from the coolant on the opposing side. This atypical heat exchanger can utilize non-traditional methods for predicting the performance of and designing such a device. The liquid side can adhere to well established heat transfer correlations, which suggest that the total heat transfer between two substances at different temperatures is equal to a heat transfer coefficient constant times the total area that it is acting on and the temperature gradient.

Heat transfer characterization and prediction on the refrigerant side, however, is more complicated due to the phase change process that occurs while the refrigerant is passing through the heat exchanger. Approximate correlations, which include experimental correction factors, have been recently determined and are discussed in detail in Carey, Van P., *Liquid-Vapor Phase Change Phenomena*, Taylor and Francis, New York (1992), which is hereby incorporated by reference. A specific embodiment of the subject invention can utilize a heat exchanger geometry which is based on correlation predictions from Carey (1992) that maximize the possible amount of heat transfer on the refrigerant side from the coolant on the other side.

Similar to the coolant side, however, the two phase heat transfer phenomenon is highly dependent upon the amount of area available for heat transfer to take place. In a specific embodiment, the design of the subject evaporative heat exchanger can, in general, maximize heat transfer area, while minimizing overall weight and dimensions and minimizing the liquid pressure drop through the heat exchanger. Preferably, the two fluids pass as close to each other as possible in order to minimize conduction heat transfer resistance through the separating medium. In a specific embodiment, a parallel channel configuration can be utilized. In a further specific embodiment, the parallel channel configuration can have a separation wall of 1 mm and can follow the path of an Archemedian spiral. An archemidian spiral is defined in a parametric coordinate system as:

$$x(t)=A\cdot t\cdot\cos(B\cdot t)$$

$$y(t)=A\cdot t\cdot\sin(B\cdot t)$$

where the constants A and B govern the number of spiral revolutions and the overall diameter of the geometry. One example yields a spiral path as is seen in FIG. 3. The path shown in FIG. 3 can be used for one fluid, while rotating the path by 180 degrees can provide a path to be used by the second fluid. In other embodiments, other interdigitiated spiral paths can also be utilized.

In a specific embodiment, the path for both fluids can begin on the outer edge of the cylinder and terminate in the center, where both fluids can exit perpendicular to the plane that they are flowing parallel on. Such a design can eliminate abrupt fluid turning points, thus minimizing pressure drop. Thin separation walls can be used to provide a sufficient length of, for example, approximately 25 inches within the limited area of the evaporator having a diameter of 53 mm. The channel depth can be chosen, using two-phase heat transfer correlations as a guide, to maximize the heat transfer area available for both fluids and meet the heat exchange rate requirements of the evaporator. In a further specific embodiment, a channel depth of about 8 mm can be used with an evaporator having 25 inch long fluid path with an evaporator diameter of 53 mm.

Figure 4:
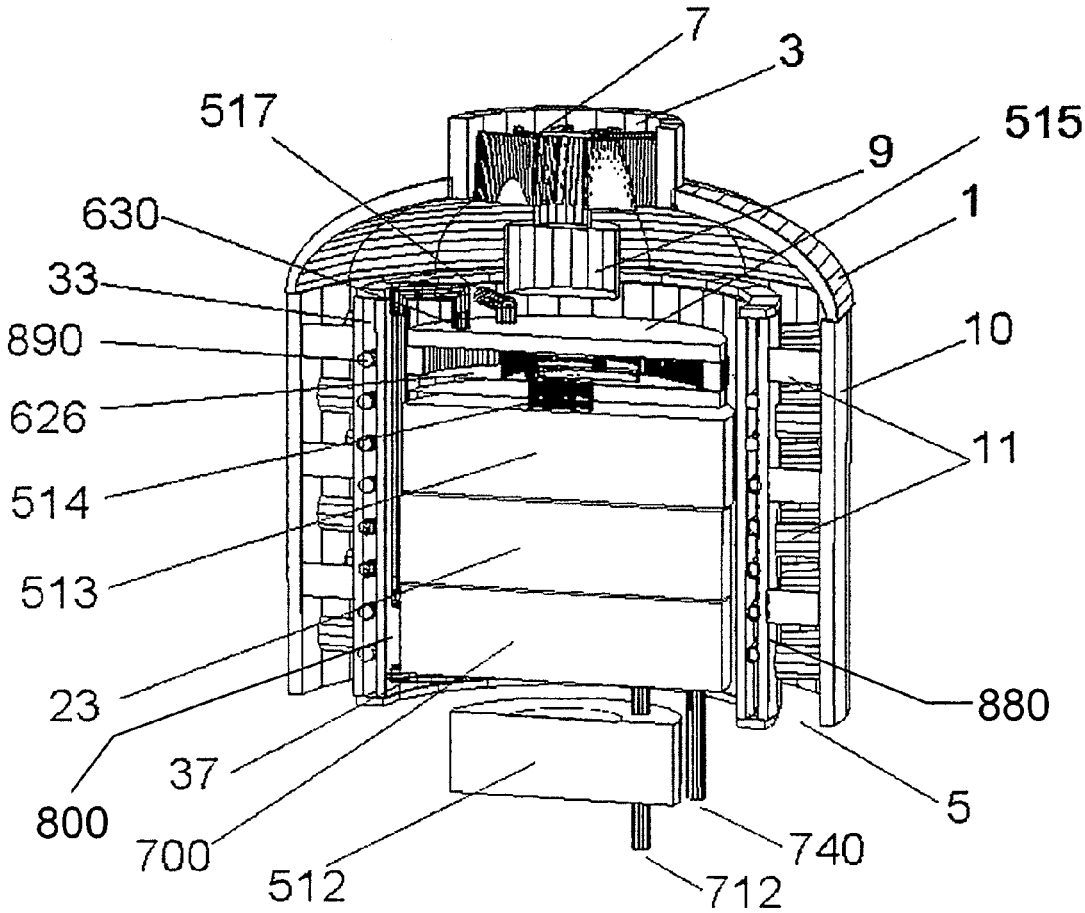
FIG. 4 shows an embodiment of the subject invention showing a view of the interior of an embodiment of the subject invention, illustrating a pump, a motor, and a motor controller.

A specific embodiment of the subject compact vapor compression cooling system, shown in FIGS. 4 and 5, can employ a compact assembly which reduces empty space. Open space can be utilized for airflow to remove heat from the cooling system. A cylindrical or spherical shape enhances the surface area of several of the components of the vapor compression cycle so as to reduce the volume of the system. In a specific embodiment, the cylindrical shape can allow for ease of assembling of the components, along with enhanced surface area to volume ratios of the components. Each of the components can be designed into cylindrical shapes, with similar diameters. The components can then be stacked together and inserted inside the condenser. This design can provide an efficient, low mass, low volume vapor compression cycle.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

We claim:

1. An apparatus for cooling, comprising:

a condenser having a heat transfer surface, wherein the condenser acts as a heat exchanger so that heat is removed from a compressed refrigerant by a first external fluid in thermal contact with the heat transfer surface of the condenser, wherein the condenser comprises a dividing wall having an interior surface and an exterior surface, wherein the interior surface is in thermal contact with the compressed refrigerant and the exterior surface is the heat transfer surface;

an expansion device, wherein the expansion device receives refrigerant from the condenser, wherein the refrigerant received from the condenser is expanded through the expansion device;

an evaporator, wherein the refrigerant exiting the expansion device flows through the evaporator, wherein the evaporator is in thermal contact with a heat source, wherein the refrigerant absorbs heat from the heat source as the refrigerant passes through the evaporator;

a compressor, wherein the compressor receives the refrigerant exiting from the evaporator, wherein the compressor compresses the refrigerant received from the evaporator, wherein the compressed refrigerant exits the compressor and flows into the condenser; and a means for flowing the first external fluid across the heat transfer surface of the condenser, wherein the flow of the first external fluid is substantially parallel with the heat transfer surface of the condenser.

2. The apparatus for cooling according to claim 1, wherein the heat source is a second external fluid, wherein the second external fluid flows through the evaporator such that the refrigerant and the second external fluid are in thermal contact, wherein the refrigerant absorbs heat from the second external fluid as the refrigerant passes through the evaporator.

3. The apparatus for cooling according to claim 2, wherein the condenser acts as a heat exchanger so that heat is removed from compressed refrigerant vapor by the first external fluid in thermal contact with the heat transfer surface of the condenser such that the temperature of the compressed refrigerant vapor decreases below the saturation temperature of the refrigerant and the refrigerant vapor condenses to liquid refrigerant, wherein the liquid refrigerant exits the condenser and is expanded through the expansion device, wherein the pressure and temperature of the liquid refrigerant are reduced upon exiting the expansion device, wherein the liquid refrigerant exiting the expansion device flows through the evaporator, wherein the second external fluid flows through the evaporator such that the liquid refrigerant and the second external fluid are in thermal contact, wherein the liquid refrigerant absorbs heat from the second external fluid as the liquid refrigerant passes through the evaporator such that the liquid refrigerant boils to produce vapor, wherein the vapor exits the evaporator, and wherein the compressor receives the refrigerant vapor exiting from the evaporator, wherein the compressor compresses the refrigerant vapor to a pressure at which the vapor temperature is above the ambient temperature of the condenser, wherein the compressed refrigerant vapor exits the compressor and flows into the condenser, wherein heat is removed from the compressed refrigerant vapor by the first external fluid in thermal contact with the heat transfer surface of the condenser such that the temperature of the compressed refrigerant vapor decreases below the saturation temperature of the refrigerant and the refrigerant vapor condenses to liquid refrigerant.

4. The apparatus for cooling according to claim 1, wherein the condenser comprises a second surface, wherein the second surface is substantially parallel to the heat transfer surface, wherein the condenser has a substantially tubular shape having a first end and a second end, wherein the heat transfer surface is on the exterior side of the substantially tubular shaped condenser and the second surface is on the interior side of the substantially tubular shaped condenser, and wherein a volume is formed by the second surface of the substantially tubular shaped condenser.

5. The apparatus for cooling according to claim 4, wherein the flow of the first external fluid is substantially from the first end of the condenser to the second end of the condenser.

6. The apparatus for cooling according to claim 1, wherein the compressed refrigerant from which heat is removed by the first external fluid in thermal contact with the heat transfer surface flows through the condenser such that the flow of the compressed refrigerant is substantially parallel to the heat transfer surface.

7. The apparatus for cooling according to claim 4, wherein the condenser has a cross-sectional shape selected from a group consisting of: rectangular, polygonal, square, hexagonal, peanut, and oval.

8. The apparatus for cooling according to claim 4, wherein the condenser has a substantially circular cross-sectional shape.

9. An apparatus for cooling comprising:

a condenser having a heat transfer surface, wherein the condenser acts as a heat exchanger so that heat is removed from a compressed refrigerant by a first extermal fluid in thermal contact with the heat transfer surface of the condenser;

an expansion device, wherein the expansion device receives refrigerant from the condenser, wherein the refrigerant received from the condenser is expanded through the expansion device;

an evaporator, wherein the refrigerant exiting the expansion device flows through the evaporator, wherein the evaporator is in thermal contact with a heat source, wherein the refrigerant absorbs heat from the heat source as the refrigerant passes through the evaporator;

a compressor, wherein the compressor receives the refrigerant exiting from the evaporator, wherein the compressor compresses the refrigerant received from the evaporator, wherein the compressed refrigerant exits the compressor and flows into the condenser; and a means for flowing the first external fluid across the heat transfer surface of the condenser, wherein the flow of the first external fluid is substantially parallel with the heat transfer surface of the condensor, wherein the condenser comprises a second surface, wherein the second surface is substantially parallel to the heat surface, wherein the condenser has a substantially tubular shape having a first end and a second end, wherein the heat transfer surface is on the exterior side of the substantially tubular shaped condenser and the second surface is on the interior side of the substantially tubular shaped condenser, and wherein a volume is formed by the second surface of the substantially tubular shaped condenser, wherein the compressor is positioned substantially within the volume formed by the second surface of the condenser.

10. The apparatus for cooling according to claim 9, wherein the evaporator is positioned substantially within the volume formed by the second surface of the condenser.

11. The apparatus for cooling according to claim 10, wherein the expansion device is positioned substantially within the volume formed by the second surface of the condenser.

12. The apparatus for cooling according to claim 9, wherein the compressor is substantially cylindrical in shape.

13. The apparatus for cooling according to claim 12, further comprising:

a motor, wherein the motor is substantially cylindrical in shape, and wherein the motor drives the compressor.

14. The apparatus for cooling according to claim 13, wherein the motor is positioned substantially within the volume formed by the second surface of the condenser.

15. The apparatus for cooling according to claim 13, further comprising:

a means for pumping the second external fluid through the evaporator.

16. The apparatus for cooling according to claim 15, wherein the motor drives the means for pumping the second external fluid through the evaporator, wherein the motor, the evaporator, and the means for pumping the second external fluid through the evaporator are positioned substantially within the volume formed by the second surface of the condenser.

17. The apparatus for cooling according to claim 15, wherein the evaporator is substantially cylindrical in shape, wherein the evaporator comprises a pair of parallel channels which spiral from the center of the evaporator to the outer portion of the evaporator, wherein the liquid refrigerant flows through one of the channels of the pairs of parallel channels and the second external fluid flows through the other channel of the pair of parallel channels such that liquid refrigerant and the second external fluid flowing in the pair of parallel channels are in thermal contact with each other.

18. The apparatus for cooling according to claim 17, wherein each channel of the pair of parallel channels substantially follows the path of a corresponding archemidian spiral.

19. The apparatus for cooling according to claim 1, wherein the condenser is a gas to vapor heat exchanger, where the vapor is hotter than the gas.

20. The apparatus for cooling according to claim 1, wherein the condenser is a liquid to vapor heat exchanger, wherein the vapor is hotter than the liquid.

21. The apparatus for cooling according to claim 1, wherein the expansion device is throttling valve.

22. The apparatus for cooling according to claim 1, wherein the temperature of the liquid refrigerant liquid is reduced to at least to corresponding saturation temperature upon exiting the expansion device.

23. The apparatus for cooling according to claim 2, wherein the second external fluid is a liquid.

24. The apparatus for cooling according to claim 2, wherein the second external fluid is a gas.

25. The apparatus for cooling according to claim 1, wherein the compressor comprises a positive displacement means such that a first volume of refrigerant vapor enters the positive displacement means and is compressed such that a second volume of compressed refrigerant vapor exits the positive displacement means, wherein the second volume is smaller than the first volume.

26. The apparatus for cooling according to claim 25, wherein the positive displacement means comprises a mechanism selected from the group consisting of: a piston, a sliding vane, a screw, and a scroll.

27. An apparatus for cooling, comprising:

a condenser having a heat transfer surface, wherein the condenser acts as a heat exchanger so that heat is removed from a compressed refrigerant by a first external fluid in thermal contact with the heat transfer surface of the condenser;

an expansion device, wherein the expansion device receives refrigerant from the condenser, wherein the refrigerant received from the condenser is expanded though the expansion device;

an evaporator, wherein the refrigerant exiting the expansion device flows through the evaporator, wherein the evaporator is in thermal contact with a heat source, wherein the refrigerant absorbs heat from the heat source as the refrigerant passes through the evaporator;

a compressor, wherein the compressor receives the refrigerant exiting from the evaporator, wherein the compressor compresses the refrigerant received from the evaporator, wherein the compressed refrigerant exits the compressor and flows into the condenser; and a means for flowing the first external fluid across the heat transfer surface of the condenser, wherein the flow of the first external fluid is substantially parallel with the heat transfer surface of the condenser, wherein the compressor comprises a positive displacement means such that a first volume of refrigerant vapor enters the positive displacement means and is compressed such that a second volume of compressed refrigerant vapor exits the positive displacement means, wherein the second volume is smaller than the first volume, wherein the positive displacement means comprises a rotary lobe, wherein the rotary lobe comprises a substantially triangular shape rotor which spins on an eccentric shaft, wherein the rotor rotates inside an epiterchoid chamber.

28. The apparatus for cooling according to claim 27, further comprising:

one or more spring loaded tip seals on the rotor.

29. The apparatus for cooling according to claim 27, further comprising:

one or more spring loaded face seals on the rotor.

30. The apparatus for cooling according to claim 27, further comprising:

a means for driving the shaft which spins the rotor.

31. The apparatus for cooling according to claim 27, further comprising:

a motor, wherein the motor drives the shaft which spins the rotor.

32. The apparatus for cooling according to claim 31, further comprising:

a motor controller, wherein the motor controller controls the speed of the motor to adjust the rate of compression cycles.

33. The apparatus for cooling according to claim 32, wherein the motor controller adjusts the rate of compression cycles to match the cooling load.

34. The apparatus for cooling according to claim 1, wherein the first external fluid is air.

35. The apparatus for cooling according to claim 1, wherein the first external fluid is water.

36. An apparatus for cooling comprising:

a condenser having a heat transfer surface, wherein the condenser acts as a heat exchanger so that heat is removed from a compressed refrigerant by a first external fluid in thermal contact with the heat transfer surface of the condenser;

an expansion device, wherein the expansion device receives refrigerant from the condenser, wherein the refrigerant received from the condenser is expanded through the expansion device;

an evaporator, wherein the refrigerant exiting the expansion device flows through the evaporator, wherein the evaporator is in thermal contact with a heat source, wherein the refrigerant absorbs heat from the heat source as the refrigerant passes through the evaporator;

a compressor, wherein the compressor receives the refrigerant exiting from the evaporator, wherein the compressor compresses the refrigerant received from the evaporator, wherein the compressed refrigerant exits the compressor and flows into the condenser; and a means for flowing the first external fluid across the heat transfer surface of the condenser, wherein the flow of the first external fluids is substantially parallel with a heat transfer surface of the condenser, wherein the compressor comprises an outside housing having a plurality of fins, wherein the plurulity of fins increases the surface area of the outside housing, wherein the increased surface area of the outside housing improves heat transfer from the outside housing.

37. The apparatus for cooling according to claim 1, wherein the heat transfer surface of the condenser comprises an enhanced surface geometry.

wherein the enhanced surface geometry enhances heat removal by the first external fluid.

38. The apparatus for cooling according to claim 37, wherein the first external fluid is ambient air, wherein the enhanced surface geometry of the heat transfer surface of the condenser comprises a plurality of extended surface features, wherein the plurality of extended surface features increase the surface area of the heat transfer surface of the condenser compared with a base surface area of the heat transfer surface of the condenser.

39. The apparatus for cooling according to claim 38, wherein the plurality of extended surface features comprises a plurality of fins extending from the heat transfer surface of the condenser.

40. The apparatus for cooling according to claim 39, wherein the cross-sectional shape of at least a portion of the plurality of fins is selected from the group of cross-sectional shapes consisting of: round, elliptical, square, and rectangular.

41. The apparatus for cooling according to claim 38, wherein the extended surface features increase the surface area of the heat transfer surface of the condenser by at least a factor of 2 compared with the base surface area of the heat transfer surface of the condenser.

42. The apparatus for cooling according to claim 38, wherein the base surface area of the heat transfer surface of the condenser is between about 200 square centimeters and about 500 square centimeters.

43. The apparatus for cooling according to claim 38, wherein the extended surface features increase the surface area of the heat transfer surface of the condenser by a factor of between about 2 and about 5 compared with the base surface area of the heat transfer surface of the condenser.

44. The apparatus for cooling according to claim 43, wherein the base surface area of the heat transfer surface of the condenser is between about 200 square centimeters and about 500 square centimeters.

45. The apparatus for cooling according to claim 44, wherein the apparatus for cooling provides up to 300 watts of cooling.

46. The apparatus for cooling according to claim 38, wherein the base surface area of the heat transfer surface of the condenser is between about 300 square centimeters and about 400 square centimeters, wherein the plurality of extended surface features increase the surface area of the heat transfer surface of the condenser by a factor of between about 2.5 and about 4, wherein the apparatus for cooling provides between about 200 and about 250 watts of cooling.

47. The apparatus for cooling according to claim 38, wherein the plurality of extended surface features have a substantially elliptical cross-section, such that the direction of air flow across the plurality of extended surface features is along the major axes of extended surface features.

48. The apparatus for cooling according to claim 47, wherein the plurality of extended surface features are positioned on the heat transfer surface of the condenser in a staggered arrangement with respect to the direction of air flowing across the heat transfer surface of the condenser.

49. The apparatus for cooling according to claim 48, wherein the spacing between the major axis of adjacent extended surface features is about 2.5 times the equivalent diameter of the elliptical cross-sectional shape of the extended surface features and the minor axes to minor axes spacing between staggered rows of extended surface features is about 2.5 times the equivalent diameter of the elliptical cross-sectional shape of the extended surface features.

50. The apparatus for cooling according to claim 4, wherein the first external fluid is ambient air, and wherein the means for flowing the first external fluid across the heat transfer surface of the condenser is a fan.

51. The apparatus for cooling according to claim 50, wherein the fan flows a portion of the first external fluid through the volume formed by the second surface of the condenser.

52. The apparatus for cooling according to claim 50, further comprising:

an outer layer, wherein the outer layer surrounds the heat transfer surface of the condenser so as to form a second volume between the heat transfer surface of the condenser and the outer layer, wherein the first external fluid flowing across the exterior surface of the condenser flows through the second volume.

53. The apparatus for cooling according to claim 52, wherein the first external fluid flowing across the heat transfer surface of the condenser flows from the first end of the condenser toward the second end of the condenser.

54. The apparatus for cooling according to claim 52, further comprising:

a means for flowing a portion of the first external fluid through the volume formed by the second surface of the condenser from the first end of the condenser to the second end of the condenser.

55. The apparatus for cooling according to claim 54, wherein the second volume between the outer layer and the heat transfer surface of the condenser is at a lower temperature than the volume formed by the second surface of the condenser.

56. The apparatus for cooling according to claim 1, further comprising:

tubing in thermal contact with the condenser, wherein the compressed refrigerant vapor flows through the tubing such that heat is transferred from the compressed refrigerant vapor to the condenser.

57. The apparatus for cooling according to claim 56, wherein the tubing spirals around in thermal contact with the condenser from the first end of the condenser to the second end of the condenser.

58. The apparatus for cooling according to claim 1, wherein the condenser comprises a first element and a second element, wherein the first element is inserted inside of the second element such that a duct is formed between the first element and the second element for the flow of the compressed refrigerant vapor through the condenser, wherein an interior surface of the second element is the interior surface of the dividing wall and an exterior surface of the second element is the heat transfer surface of the condenser.

59. The apparatus for cooling according to claim 58, wherein the duct is a helical duet.

60. The apparatus for cooling according to claim 58, wherein a plurality of ducts are formed between the first element and the second element such that the plurality of ducts are parallel with each other.

61. The apparatus for cooling according to claim 6, wherein the flow of the compressed refrigerant is substantially perpendicular to the flow of the first external fluid.

62. The apparatus according to claim 4, wherein the second surface of the condenser comprises an enhanecd surface geometry, wherein the enhanced surface geometry enhances heat removal by the first external fluid.

63. The apparatus according to claim 62, wherein the first external fluid is ambient air, wherein the enhanced surface geometry of the heat transfer surface of the condenser comprises a plurality of extended surface features, wherein the plurality of extended surface features increase the surface area of the heat transfer surface of the condenser compared with a base surface area of the heat transfer surface of the condenser.

* * * * *

UNITED STATES PATENT AND TRADEMARK OFFICE

CERTIFICATE OF CORRECTION

PATENT NO. : 7,010,936 B2
APPLICATION NO. : 10/625014
DATED : March 14, 2006
INVENTOR(S) : Daniel P. Rini et al.

It is certified that error appears in the above-identified patent and that said Letters Patent is hereby corrected as shown below:

Column 2,
Lines 45-47, "300 Watts of heating while consuming less than about 100 Watts of electrical power" should read --300 watts of heating while consuming less than about 100 watts of electrical power--.

Column 4,
Line 42, "with the subject invention" should read --with the subject invention.--.

Column 4,
Line 62, "epiterchoid" should read --epitrochoid--.

Column 6,
Line 9, "users body while allowing" should read --user's body while allowing--.
Lines 11-12, "against a users body" should read --against a user's body--.
Line 28, "show in FIGS. 11A and 11B" should read --shown in FIGS. 11A and 11B--.
Lines 45-46, "about 300 Watts of heat while consuming less than about 100 Watts" should read --about 300 watts of heat while consuming less than about 100 watts--.

Column 8,
Line 29, "epiterchoid" should read --epitrochoid--.
Line 42, "an epiterchoid shape" should read --an epitrochoid shape--.
Lines 53-54, "epiterchoid" should read --epitrochoid.

Column 8,
Lines 55-56, "epiterchoid" should read --epitrochoid--.
Line 61, "epiterchoidal" should read --epitrochoidal--.

Column 9,
Line 22, "In embodiment the second" should read --In an embodiment, the second--.
Lines 45-46, "of to compressor housing" should read --of the compressor housing--.

Column 10,
Line 17, "in order maximize" should read --in order to maximize--.
Line 33, "epiterchoidal" should read --epitrochoidal--.
Lines 42-43, "low friction, low corrosion materials" should read --low friction and low corrosion materials--.

Column 12,
Line 62, "To remove 200 Watts of heat" should read --To remove 200 watts of heat--.

UNITED STATES PATENT AND TRADEMARK OFFICE

CERTIFICATE OF CORRECTION

PATENT NO. : 7,010,936 B2
APPLICATION NO. : 10/625014
DATED : March 14, 2006
INVENTOR(S) : Daniel P. Rini et al.

It is certified that error appears in the above-identified patent and that said Letters Patent is hereby corrected as shown below:

Column 13,
Line 49, "given number of times, N, given by" should read --given number of times, *N*, given by--.
Line 57, "where n is the number" should read --where *n* is the number--.

Fifth column of table at column 14,
Line 6, "N" should read --*N*--.

Column 16,
Lines 44-45, "An archemidian spiral" should read --An Archemidian spiral--.
Line 51, "where the constants A and B" should read -- where the constants *A* and *B*--.

Column 18,
Line 65, " An apparatus for cooling comprising" should read --An apparatus for cooling, comprising--.

Column 19,
Line 21, "surface of the condensor" should read --surface of the condenser--.
Line 24, "the heat surface" should read --heat transfer surface--.

Column 20,
Line 19, "is throttling valve" should read --is a throttling valve.--.

Column 21,
Line 8, "epiterchoid" should read --epitrochoid--.
Line 34, "for cooling comprising" should read --for cooling, comprising--.

Column 24,
Line 16, "is a helical duet." should read --is a helical duct.--.

UNITED STATES PATENT AND TRADEMARK OFFICE

CERTIFICATE OF CORRECTION

PATENT NO. : 7,010,936 B2
APPLICATION NO. : 10/625014
DATED : March 14, 2006
INVENTOR(S) : Daniel P. Rini et al.

It is certified that error appears in the above-identified patent and that said Letters Patent is hereby corrected as shown below:

Column 24,
Line 8, "enhanecd surface geometry" should read --enhanced surface geometry--.

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,010,936 B2
APPLICATION NO. : 10/625014
DATED : March 14, 2006
INVENTOR(S) : Daniel P. Rini et al.

It is certified that error appears in the above-identified patent and that said Letters Patent is hereby corrected as shown below:

Column 1,
Lines 1-6, "METHOD AND APPARATUS FOR HIGHLY EFFICIENT COMPACT VAPOR COMPRESSION COOLING
CROSS-REFERENCE TO RELATED APPLICATION" should read --METHOD AND APPARATUS FOR HIGHLY EFFICIENT COMPACT VAPOR COMPRESSION COOLING
This invention was made with Government support under W911QY-05-C-0006 awarded by the US Army RDECOM Contracting Center, Natick Contracting Division, Natick, MA, 01760. The Government has certain rights in the invention
CROSS-REFERENCE TO RELATED APPLICATION--.

Signed and Sealed this

Third Day of November, 2009

David J. Kappos

David J. Kappos
*Director of the United States Patent and Trademark Office*